US011299877B2

(12) United States Patent
Mesun et al.

(10) Patent No.: US 11,299,877 B2
(45) Date of Patent: Apr. 12, 2022

(54) FLUID CONNECTOR FOR TOILET

(71) Applicant: Kohler Co., Kohler, WI (US)

(72) Inventors: Randy O. Mesun, Sheboygan, WI (US); Jeremiah J. Rauwerdink, Sheboygan, WI (US); Daniel N. Halloran, Saukville, WI (US); Keith E. Muellenbach, Sheboygan, WI (US); Jennifer L. Tarplee, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 16/788,570

(22) Filed: Feb. 12, 2020

(65) Prior Publication Data

US 2020/0277774 A1 Sep. 3, 2020

Related U.S. Application Data

(60) Provisional application No. 62/811,988, filed on Feb. 28, 2019.

(51) Int. Cl.
*E03D 11/13* (2006.01)
*E03D 11/18* (2006.01)

(52) U.S. Cl.
CPC ..... *E03D 11/13* (2013.01); *E03D 11/18* (2013.01)

(58) Field of Classification Search
CPC ..... E03D 11/13; E03D 11/18; E03D 5/00; E03D 11/00; E03D 11/03
USPC ..... 4/425
See application file for complete search history.

(56) References Cited

U.S. PATENT DOCUMENTS 423,175 A 3/1890 Newell
588,292 A * 8/1897 Putnam ..... 4/425
769,520 A 9/1904 Waldmann
(Continued)

FOREIGN PATENT DOCUMENTS

AU 751403 9/1999
CN 1402807 A 3/2003
(Continued)

OTHER PUBLICATIONS

Chinese Office Action for Chinese Application No. 202010129026.1 dated Jan. 25, 2021.
(Continued)

*Primary Examiner* — Benjamin R Shaw
(74) *Attorney, Agent, or Firm* — Lempia Summerfield Katz LLC

(57) ABSTRACT

A toilet assembly includes a toilet, a non-vitreous fluid delivery component, and a connector assembly. The non-vitreous fluid delivery component is coupled to, and in fluid communication with, the toilet. The connector assembly couples the non-vitreous fluid delivery component to the toilet in a substantially watertight manner. The connector assembly includes a connector body, a nut adjustably coupled to the connector body, and a sealing member disposed on the connector body. The nut is configured to be adjusted relative to the connector body to cause the connector body to compress the sealing member against a portion of the toilet, such that the sealing member creates a substantially watertight seal between the toilet and the connector body.

19 Claims, 21 Drawing Sheets

(56) References Cited

U.S. PATENT DOCUMENTS 1,111,747 A * 9/1914 Haas ..... E03D 1/18 4/336
1,132,953 A 3/1915 Mann
1,142,092 A * 6/1915 Haas ..... E03D 11/13 4/422
1,830,106 A * 11/1931 Groeniger ..... E03D 11/13 4/423
1,928,717 A 10/1933 Campus
1,956,085 A * 4/1934 Tracy ..... E03D 11/13 4/422
1,956,086 A * 4/1934 Tracy ..... E03D 11/13 4/427
1,973,349 A * 9/1934 Kruse ..... E03D 11/06 4/425
1,998,861 A * 4/1935 Campus ..... E03D 9/14 4/422
2,034,173 A * 3/1936 Brooks ..... E03D 11/13 4/423
2,116,528 A * 5/1938 McNeil ..... E03D 11/02 4/425
2,116,529 A * 5/1938 McNeil ..... E03D 11/02 4/423
2,183,897 A 12/1939 Stiller
3,224,013 A 12/1965 Tubbs
3,983,582 A 10/1976 Morris et al.
4,086,668 A 5/1978 Tubbs
4,106,131 A 8/1978 Delker
4,710,987 A 12/1987 Mesun et al.
5,052,060 A 10/1991 Makita et al.
5,204,999 A * 4/1993 Makita ..... E03D 5/00 4/300
5,502,845 A * 4/1996 Hayashi ..... E03D 11/02 4/300
6,161,568 A * 12/2000 Dragotta ..... E03C 1/025 137/148
6,247,193 B1 6/2001 Riepl
6,263,519 B1 7/2001 Parsons et al.
6,321,395 B1 11/2001 Parsons et al.
6,370,707 B1 4/2002 Parsons et al.
6,397,405 B1 6/2002 Grech et al.
6,425,145 B1 7/2002 Parsons et al.
6,453,479 B1 9/2002 Parsons et al.
6,634,034 B2 10/2003 Rendell
6,675,399 B1 1/2004 Tomita et al.
6,823,535 B2 11/2004 Tomita et al.
6,934,976 B2 8/2005 Parsons et al.
7,036,159 B2 5/2006 Tomita et al.
7,069,604 B2 7/2006 Tomita et al.
7,305,721 B2 12/2007 Matsui et al.
7,594,282 B2 9/2009 Shirai
7,640,604 B2 1/2010 Cummings
8,032,956 B2 10/2011 Prokopenko et al.
8,316,475 B2 11/2012 Grover
8,418,277 B2 4/2013 Okubo et al.
8,793,818 B2 8/2014 Inglin et al.
8,978,172 B2 3/2015 Plate et al.
9,045,887 B2 6/2015 O'Malley
9,481,992 B2 11/2016 Stammel et al.
9,737,181 B1 8/2017 Hall et al.
9,835,276 B2 * 12/2017 Wu ..... F16L 37/08
2003/0088910 A1 * 5/2003 Hidetaka ..... E03D 1/28 4/425
2004/0068785 A1 4/2004 Tomita et al.
2004/0083541 A1 5/2004 Ogren
2005/0015871 A1 1/2005 Tomita et al.
2005/0268391 A1 12/2005 Reichmuth et al.
2006/0101566 A1 5/2006 Parsons et al.
2007/0289053 A1 12/2007 Tolbert
2008/0276362 A1 11/2008 O'Malley et al.
2010/0125940 A1 5/2010 Sigler et al.
2011/0231989 A1 9/2011 O'Malley et al.
2011/0314597 A1 12/2011 Von Ballmoos
2013/0305445 A1 * 11/2013 Stammel ..... E03D 11/06 4/417
2015/0107008 A1 4/2015 Kuo et al.
2017/0067241 A1 * 3/2017 Kashirajima ..... E03D 11/08
2017/0247871 A1 * 8/2017 Mukerji ..... E03D 11/18
2018/0195260 A1 * 7/2018 Tinsley ..... E03D 5/092
2020/0063418 A1 * 2/2020 Mori ..... E03D 11/02
2020/0277775 A1 * 9/2020 Halloran ..... B05B 1/042

FOREIGN PATENT DOCUMENTS

CN 1422355 6/2003
CN 1555447 12/2004
CN 203498964 U 3/2014
CN 103790222 A 5/2014
CN 104988973 10/2015
CN 107587573 A 1/2018
CN 108700240 A 10/2018
DE 20120168 4/2003
EP 2 843 142 A1 3/2015
GB 0 493 000 A 9/1938
JP 2606021 4/1974
JP H06-299585 A 10/1994
JP 2000-352485 12/2000
JP 2002-088881 A1 3/2002
JP 2004156282 A 6/2004
JP 2004-270163 A 9/2004
JP 2005163387 A 6/2005
JP 2010106447 A 5/2010
WO WO-84/01973 5/1984
WO WO-2008/024005 2/2008

OTHER PUBLICATIONS

Chinese Office Action for Chinese Application No. 202010129026.1 dated Jul. 16, 2021.
Chinese Office Action for Chinese Application No. 202010129026.1 filed Nov. 17, 2021, with English translation.

* cited by examiner

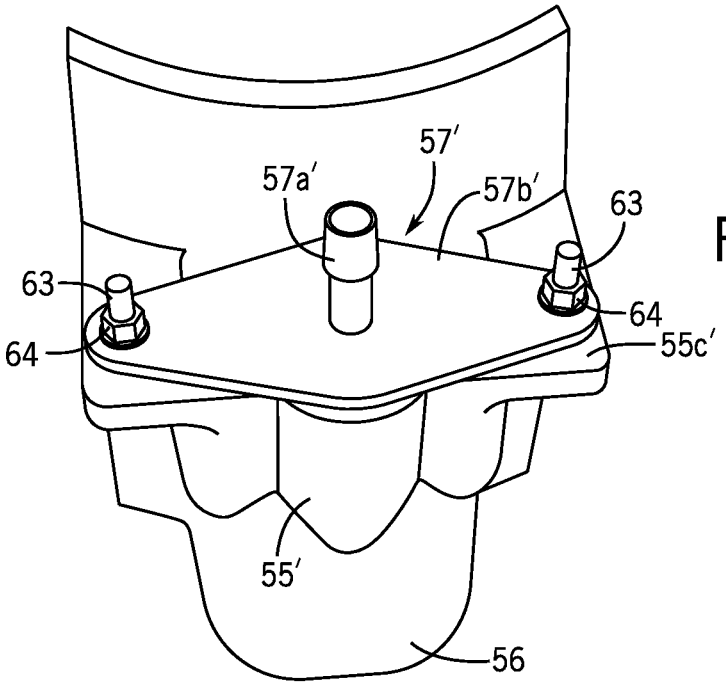
FIG. 34
FIG. 35
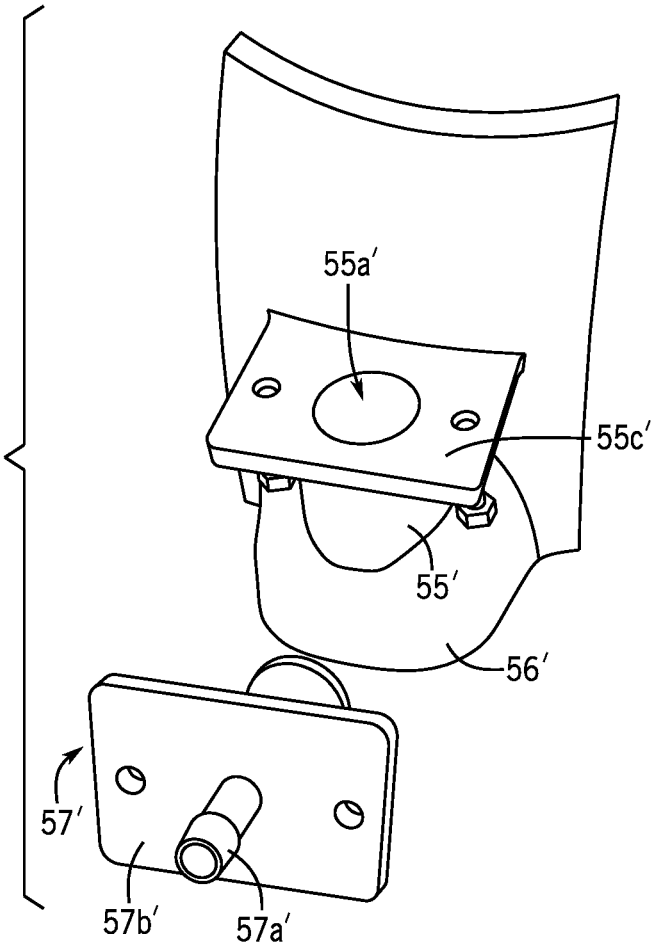

FLUID CONNECTOR FOR TOILET

CROSS-REFERENCE TO RELATED PATENT APPLICATION

This application claims the benefit of and priority to U.S. Provisional Application No. 62/811,988, filed Feb. 28, 2019, the entire disclosure of which is hereby incorporated by reference herein.

BACKGROUND

The present application relates generally to the field of connectors for fluidly coupling a non-vitreous fluid delivery component to a vitreous plumbing fixture, such as a toilet.

Generally speaking, a toilet can include various openings for fluidly coupling a fluid delivery component (e.g., conduit, sump jet, etc.) to the toilet, such as at a sump or a rim of the toilet. Most toilets are typically made from a vitreous material, which can present significant challenges for connecting a component that is made from a non-vitreous material (e.g., plastic, etc.) to the toilet in a watertight manner. Specifically, most non-vitreous components do not bond to vitreous material. Thus, conventional techniques of joining two vitreous components together may not be used to couple a non-vitreous component to a toilet.

Accordingly, it would be advantageous to provide a connector between a non-vitreous fluid delivery component and a vitreous toilet to ensure a substantially watertight connection between the fluid delivery component and the toilet.

SUMMARY

One embodiment relates to a toilet assembly. The toilet assembly includes a toilet, a non-vitreous fluid delivery component, and a connector assembly. The non-vitreous fluid delivery component is coupled to, and in fluid communication with, the toilet. The connector assembly couples the non-vitreous fluid delivery component to the toilet in a substantially watertight manner. The connector assembly includes a connector body, a nut adjustably coupled to the connector body, and a sealing member disposed on the connector body. The nut is configured to be adjusted relative to the connector body to cause the connector body to compress the sealing member against a portion of the toilet, such that the sealing member creates a substantially watertight seal between the toilet and the connector body.

Another embodiment relates to a connector assembly for coupling a non-vitreous fluid delivery component to a toilet. The connector assembly includes a connector body, a nut adjustably coupled to the connector body, and a sealing member disposed on the connector body. The nut is configured to be adjusted relative to the connector body to cause the connector body to compress the sealing member against a portion of the toilet, such that the sealing member creates a substantially watertight seal between the toilet and the connector body.

Another embodiment relates to a sump jet assembly for a toilet. The sump jet assembly includes a non-vitreous sump jet configured to be coupled to, and in fluid communication with, a sump of the toilet. The sump jet assembly further includes a connector assembly for coupling the non-vitreous sump jet to the toilet in a substantially watertight manner. The connector assembly includes a connector body, a nut adjustably coupled to the connector body, and a sealing member disposed on the connector body. The nut is configured to be adjusted relative to the connector body to cause the connector body to compress the sealing member against a portion of the toilet, such that the sealing member creates a substantially watertight seal between the toilet and the connector body.

In some exemplary embodiments, the connector body includes a first portion for fluidly coupling to a conduit, a second portion extending from the first portion, the second portion including threads for threadably engaging the nut, and a third portion extending from the second portion, wherein the sealing member is disposed on the third portion.

In some exemplary embodiments, the third portion has a frusto-conical shape, and the connector body includes an opening extending through each of the first, second, and third portions.

In some exemplary embodiments, the sealing member includes a body and a flange, the flange extending radially away from an end of the body, and the sealing member is arranged on the connector body with the flange facing toward the first portion and the body facing toward the third portion.

In some exemplary embodiments, the toilet includes an opening for receiving at least a portion of the body therethrough, and the flange is engaged with a surface of the toilet adjacent the opening.

In some exemplary embodiments, the body of the sealing member extends radially outwardly in the opening of the toilet in response to tightening of the nut on the connector body so as to create the substantially watertight seal between the toilet and the connector body.

In some exemplary embodiments, the toilet includes a sump, and the non-vitreous fluid delivery component is a sump jet that is coupled to the sump.

In some exemplary embodiments, the toilet is made from at least one of a vitreous material, an epoxy material, or a ceramic material.

In some exemplary embodiments, the non-vitreous fluid delivery component is integrally formed with the connector body.

In some exemplary embodiments, the non-vitreous fluid delivery component is coupled to the connector body.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which:

FIG. 34 is a perspective view of a prototype version of the toilet assembly of FIG. 32.

FIG. 35 is an exploded view of a prototype version of a toilet assembly including a non-vitreous fluid delivery component coupled to a toilet according to another exemplary embodiment.

DETAILED DESCRIPTION

Figure 1:
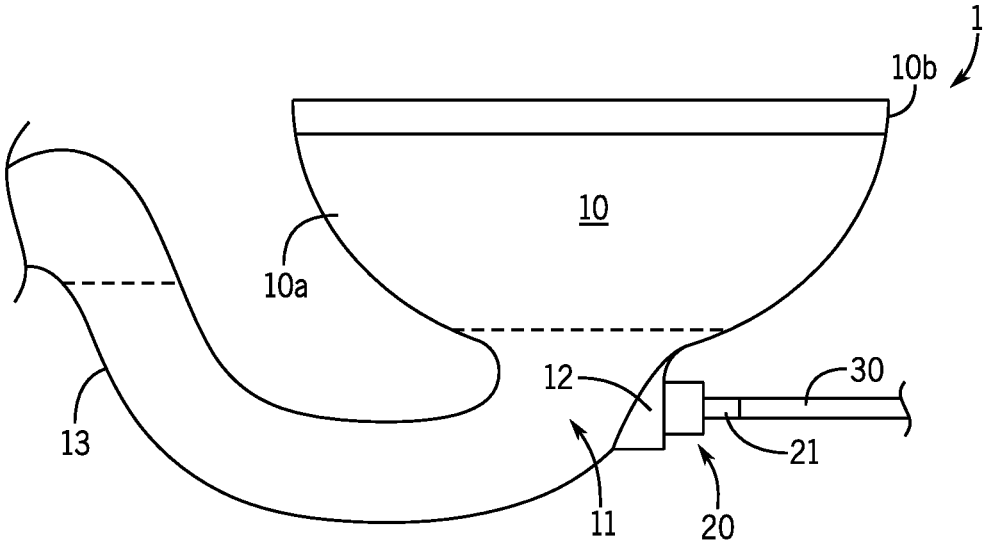
FIG. 1 is a schematic view of a toilet assembly including a toilet and a non-vitreous fluid delivery component coupled to the toilet according to an exemplary embodiment.
Figure 2:
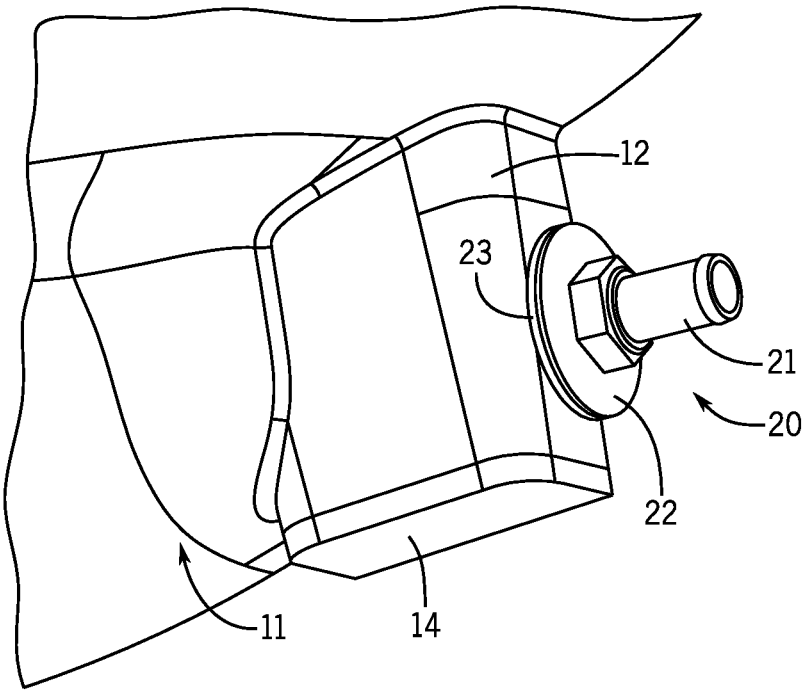
FIG. 2 is a partial perspective view of the toilet assembly of FIG. 1.
Figure 3:
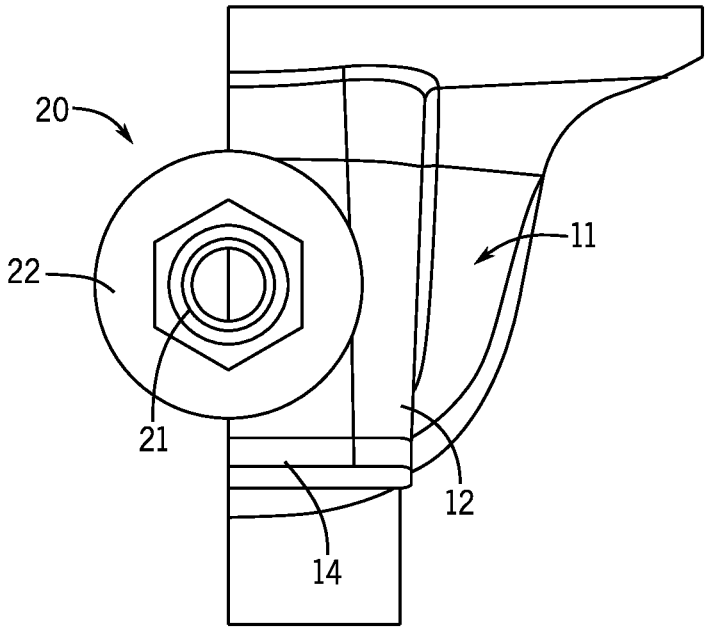
FIG. 3 is a partial front view of the toilet assembly of FIG. 1.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, disclosed herein are connectors for fluidly coupling a non-vitreous fluid delivery component to an inlet in a vitreous toilet according to various exemplary embodiments. Specifically, the connectors provide a substantially watertight seal with a portion of the vitreous toilet (e.g., a toilet sump, a toilet rim, etc.), such that the non-vitreous fluid delivery component can be fluidly coupled to the toilet in a substantially watertight manner.

According to various exemplary embodiments, the connectors disclosed herein are used specifically for fluidly coupling a non-vitreous fluid delivery component to a sump of a vitreous toilet. According to an exemplary embodiment, the toilet is a siphonic toilet that relies on a siphon effect to empty the contents of the toilet bowl, and the non-vitreous fluid delivery component is a sump jet made from a non-vitreous material (e.g., plastic, etc.) that can introduce a flow of water into the sump of the toilet to help to prime the siphon. It should be appreciated, however, that the various connectors disclosed herein may be used to fluidly couple other non-vitreous components to other vitreous portions of a toilet (e.g., a fluid conduit to a rim of a toilet, a waste pipe to a toilet, an internal fluid conduit of a toilet, etc.). According to other exemplary embodiments, the disclosed connectors may be used to couple other non-vitreous fluid delivery components (e.g., fluidic jets, nozzles, etc.) to plumbing fixtures made from vitreous or other materials besides vitreous in a substantially watertight manner, such as epoxy, ceramic, or other types of materials or combinations of materials.

According to an exemplary embodiment, the sump jets used in conjunction with the various connectors disclosed herein are configured substantially the same as each other (e.g., similar jet orifice configuration, etc.). According to other exemplary embodiments, the sump jets may be configured differently from each other. According to various exemplary embodiments, the sump jets disclosed herein may be configured the same as, or similar to, any one of, or a combination of, the sump jets disclosed in U.S. patent application Ser. No. 15/414,576, entitled "LINE PRESSURE-DRIVEN, TANKLESS, SIPHONIC TOILET," filed Jan. 24, 2017, the entire disclosure of which is hereby incorporated by reference herein.

In the various exemplary embodiments disclosed herein, the non-vitreous fluid delivery components are made from a non-vitreous material, such as plastic (e.g., a fiber-reinforced plastic such as HDPE, PVC, GF Polypropylene, PBT, etc.), although other types of non-vitreous materials or combinations of materials may be used (e.g., aluminum, composites, etc.). The various sealing members and seals disclosed herein (e.g., sealing member 23, etc.) may be made from a compressible material (e.g., rubber, etc.) that is configured to sealingly engage a vitreous surface of a plumbing fixture, such as a toilet, so as to create a substantially watertight seal therebetween.

Referring to FIG. 1, a toilet assembly 1 is shown according to an exemplary embodiment. The toilet assembly 1 includes a toilet 10 and a non-vitreous fluid delivery component, shown as a sump jet 21, fluidly coupled to the toilet 10. According to an exemplary embodiment, the toilet 10 is a siphonic toilet that relies on a siphon effect to empty the contents of the toilet bowl. For example, the toilet 10 includes a bowl 10*a*, a sump 11 extending from the bowl 10*a*, and a trapway 13 extending from the sump 11 to a drain. The trapway 13 routes rearwardly and then upwardly to a height above the normal water level in the bowl 10*a* to create a weir that acts as a gas trap for back gases from the drain. The trapway 13 is configured to induce a siphon effect, which provides pressure to suction waste water from the bowl 10*a* when a flush is activated. The sump jet 21, described in more detail below, is coupled to and in fluid communication with the sump 11. According to an exemplary embodiment, the sump jet 21 is configured to receive a flow of water at a low inlet flow rate, such as at a normal household water flow rate of between about 2.5 gpm and about 5 gpm, and to increase the flow rate before introducing the flow of water into the sump 11. The flow of water provided by the sump jet 21 can, advantageously, increase the flow rate of water in the sump 11 and the trapway 13 to a flow rate comparable to a conventional gravity-based toilet design (e.g., about 20-25 gpm) to initiate the siphon effect. According to other exemplary embodiments, the toilet 10 may be configured as a gravity-fed toilet or other type of toilet and the sump jet 21 may be configured as any other type of fluidic jet or nozzle for delivering fluid to the toilet to, for example, help to induce a siphon in the trapway of the toilet.

As shown in FIGS. 2-5, the toilet 10 further includes a secondary chamber 12 (e.g., jet chamber, etc.) extending outwardly or forward in front of the sump 11. The secondary chamber 12 is formed of a vitreous material, and may be integrally formed with, or coupled to, the toilet 10. The sump jet 21 is coupled to the secondary chamber 12 at a first opening 12*a* (e.g., first inlet, etc.). The secondary chamber 12 is in fluid communication with the sump 11 by a second opening 12*b* (e.g., second inlet, sump inlet, etc.). The sump jet 21 extends through the first opening 12*a* and into the secondary chamber 12 adjacent the sump 11 at the second opening 12*b*. The sump jet 21 is fluidly coupled to a conduit 30, which is in turn in fluid communication with a water source, such as a household water supply.

According to an exemplary embodiment, the sump jet 21 is configured to receive a flow of water from a water source and deliver the flow of water to the sump 11 to prime a siphon in the trapway 13. A connector assembly 20 couples the sump jet 21 to the sump 11 in a substantially watertight manner. The connector assembly 20 comprises a nut 22 that is adjustably coupled to a portion of the sump jet 21 (e.g., second portion 21*b*, discussed in greater detail below). The connector assembly 20 further comprises a sealing member 23 (e.g., a spud seal, etc.) disposed between the nut 22 and a portion of the secondary chamber 12. The sealing member 23 includes a flange 23*a* and a body 23*b* extending from the flange 23*a*. The flange 23*a* is configured to sealingly engage an outer vitreous surface of the toilet that defines part of the secondary chamber 12. The body 23*b* extends at least partially into the opening 12*a* of the secondary chamber, and is configured to sealingly engage a vitreous portion of the secondary chamber that defines the opening 12*a*. The sealing member 23 is configured to create a substantially watertight seal between the sump jet 21 and a vitreous portion of the secondary chamber 12, as discussed in greater detail below.

Figure 4:
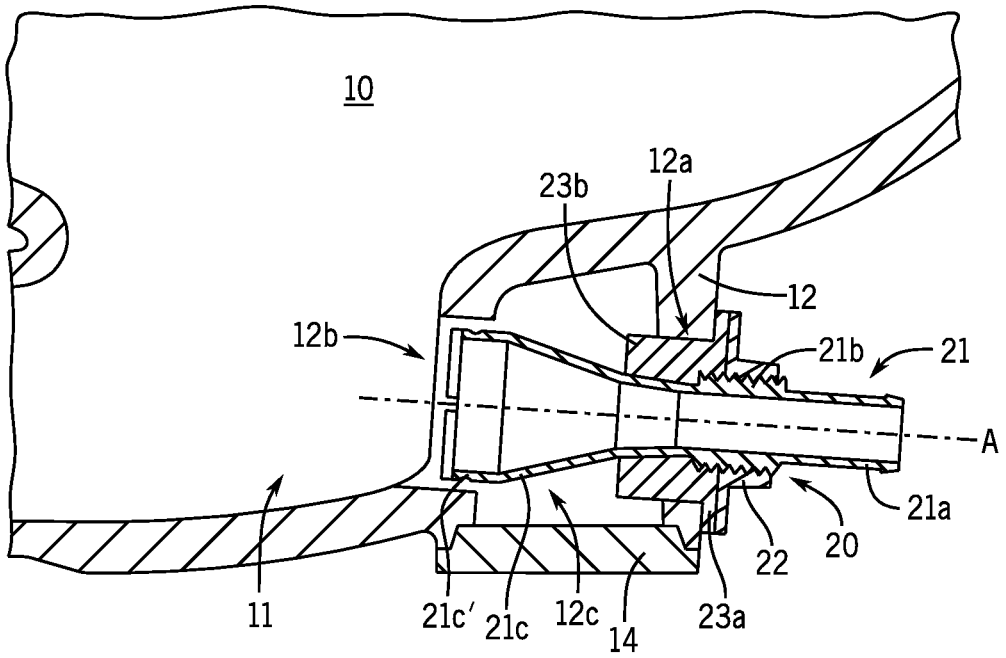
FIG. 4 is a partial cross-sectional view of the toilet assembly of FIG. 1.

Referring to FIG. 4, the sump jet 21 includes a first portion 21*a* (e.g., inlet portion, etc.) having a generally hollow cylindrical shape that defines a central channel having an axis represented by a dashed line in FIG. 4. The first portion 21*a* further includes a flared end that defines a hose barb configured to couple to, and be in fluid communication with, the conduit 30. The sump jet 21 further includes a second portion 21*b* (e.g., intermediate portion, etc.) extending from the first portion 21*a*. The second portion 21*b* includes a plurality of threads disposed on an outer surface thereof for threadably engaging corresponding threads on the nut 22. The sump jet 21 further includes a third portion 21*c* (e.g., outlet portion, etc.) extending from the second portion 21*b*. The third portion 21*c* includes one or more jet orifices in fluid communication with the central channel for introducing a flow of water from a water source into the sump 11. The third portion 21*c* gradually increases in diameter from the second portion 21*b*, so as to define a generally frusto-conical shape. The third portion 21*c* includes a channel 21*c*' extending along an outer periphery thereof for receiving a seal (e.g., an O-ring, etc.), so as to create a seal between the third portion 21*c* and a vitreous portion of the toilet 10 that defines the second opening 12*b*. According to an exemplary embodiment, the seal created between the seal at the channel 21*c*' and the vitreous portion of the toilet at the second opening 12*b* is not watertight, but can help to axially align the sump jet 21 to the secondary chamber 12 at the second opening 12*b*.

As shown in FIG. 4, the sump jet 21 is shown with the third portion 21*c* at least partially disposed in the second opening 12*b* between the secondary chamber 12 and the sump 11. The second portion 21*b* is disposed at least partially into the first opening 12*a* between the secondary chamber 12 and an outer vitreous surface of the toilet. The first portion 21*a* is disposed entirely outside of the toilet to couple to the conduit 30. The sealing member 23 is disposed around the second portion 21*b* with the body 23*b* facing toward the third portion 21*c* and the flange 23*a* facing toward the first portion 21*a*. The sump jet 21 may be inserted into the secondary chamber 12 such that the second portion 21*a* extends partially into the first opening 12*a* and past an outer surface of the toilet 10 that defines the secondary chamber 12. The sealing member 23 may be positioned such that the body 23*b* is inserted through the first opening 12*a* between the second portion 21*b* and the secondary chamber 12. The flange 23*a* of the sealing member 23 may be sealingly engaged with an outer vitreous surface of the secondary chamber 12 adjacent the first opening 12*a*. The nut 22 may be threadably coupled to the second portion 21*b* extending in front of the secondary chamber 12 and abutting the flange 23*a*. The nut 22 may be tightened against the flange 23*a* and the vitreous portion of the secondary chamber 12 until a trailing edge of the body 23*b* is sufficiently engaged by the third portion 21*c*, so as to sandwich the sealing member 23 between the third portion 21*c* and the vitreous portion of the secondary chamber 12 to create a substantially watertight seal between the sump jet 21 and the secondary chamber 12.

In other words, the frusto-conical profile of the third portion 21*c* is urged toward the first opening 12*a* as the nut 22 is adjusted on the second portion 21*b*, which causes the sealing member 23 to compress and expand radially between the secondary chamber 12 and the sump jet 21 into the first opening 12*a*. In this manner, the connector assembly 20 can create a substantially watertight seal between the non-vitreous sump jet 21 and the vitreous toilet 10.

Figure 5:
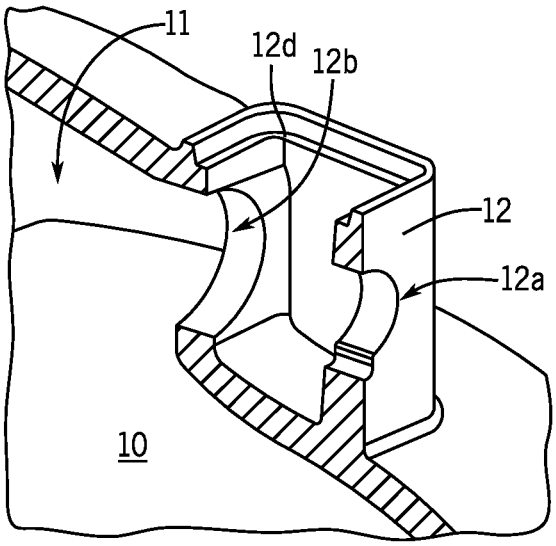
FIG. 5 is a partial cutaway view of the toilet of FIG. 1.

Referring to FIGS. 4-5, the secondary chamber 12 may include an open bottom 12*c* to provide access to an interior of the secondary chamber 12. The secondary chamber 12 includes a peripheral flange 12*d* (e.g., channel, recess, etc.) for receiving a cover 14 to enclose the secondary chamber 12 after installation of the sump jet 21 and connector assembly 20. According to an exemplary embodiment, the cover 14 is made from a vitreous material and is bonded to the peripheral flange 12*d* (e.g., glued, etc.). According to other exemplary embodiments, the cover 14 is made from a material other than vitreous and is otherwise coupled to the secondary chamber 12. According to another exemplary embodiment shown in FIGS. 6-8, for example, the secondary chamber 12 may have an open front area for receiving a cover instead of the bottom of the secondary chamber, depending on manufacturing preference.

Figure 6:
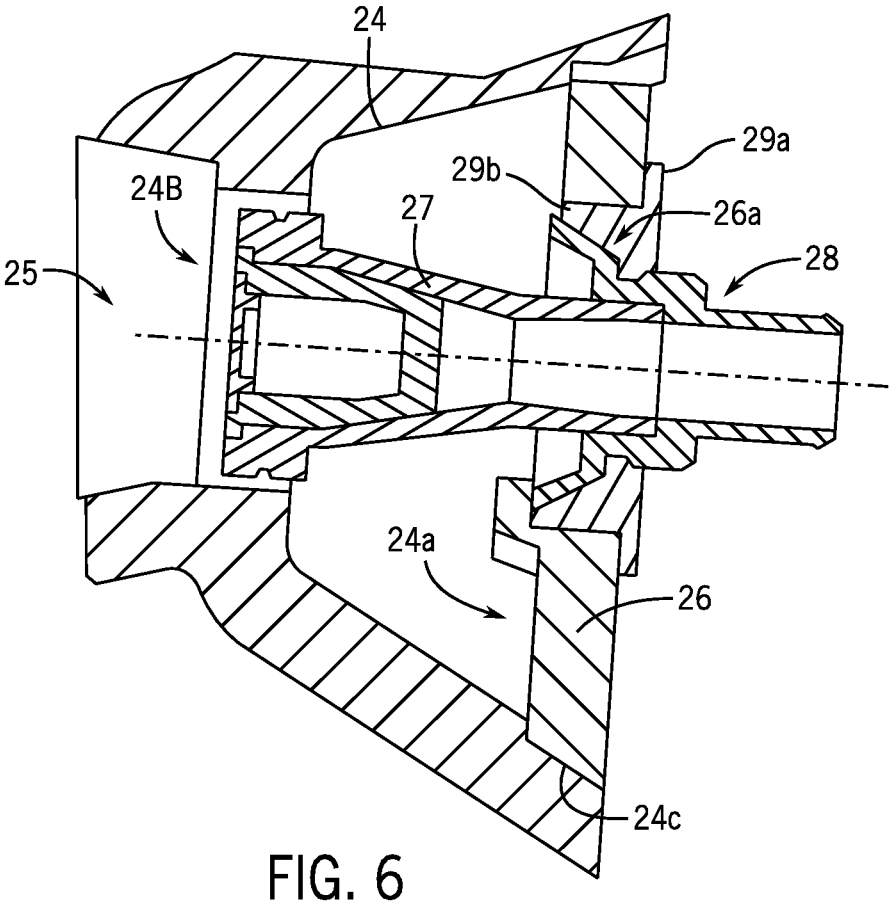
FIG. 6 is a partial cross-sectional view of a non-vitreous fluid delivery component coupled to a toilet according to another exemplary embodiment.
Figure 7:
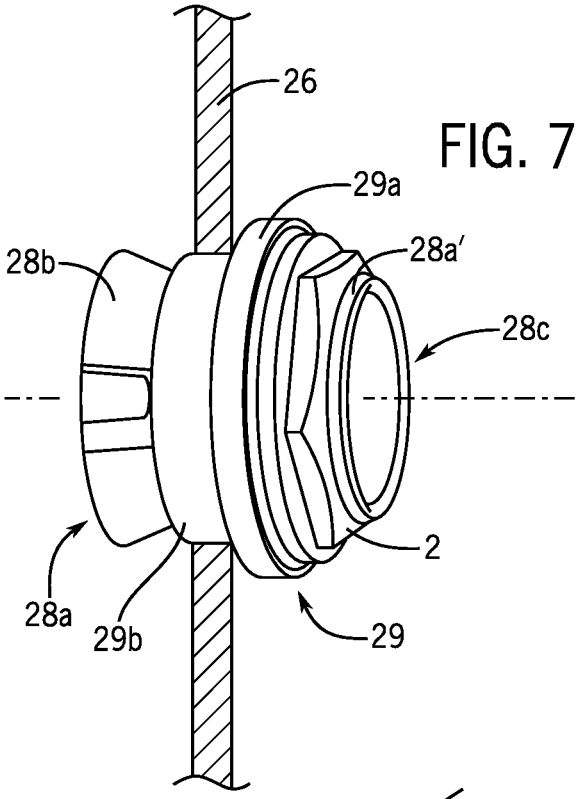
FIG. 7 is a partial cross-sectional view of a connector assembly of FIG. 6.
Figure 8:
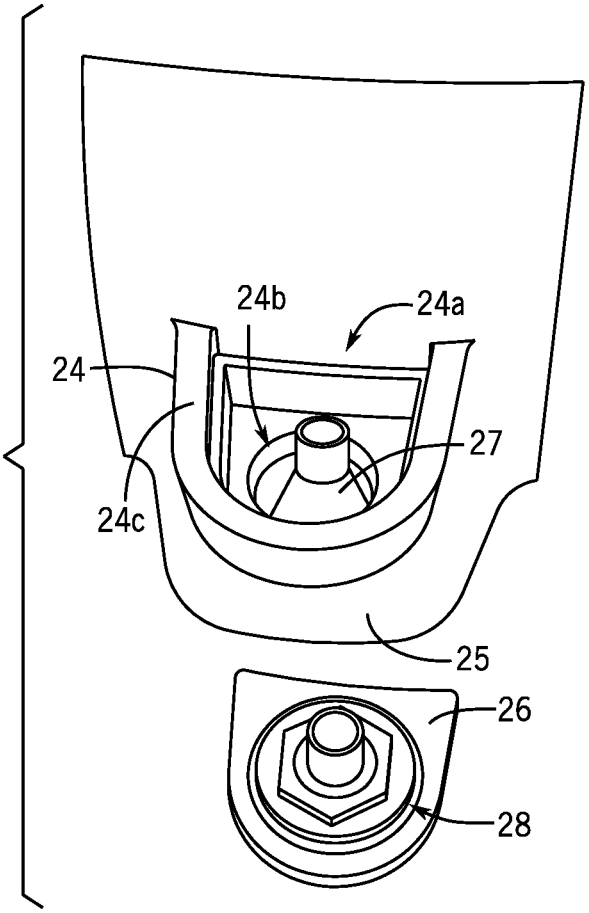
FIG. 8 is a perspective view of a prototype version of the non-vitreous fluid delivery component, toilet, and connector assembly of FIG. 6.

Referring to FIGS. 6-8, a non-vitreous fluid delivery component, shown as a sump jet 27, is coupled to a secondary chamber 24 of a toilet by a connector assembly 28, according to another exemplary embodiment. In this exemplary embodiment, the connector assembly 28 and the sump jet 27 are configured to be substantially the same as the connector assembly 20 and the sump jet 21 of the embodiment of FIG. 4, but the secondary chamber 24 includes an opening at a front portion of the secondary chamber instead of along a bottom portion of the secondary chamber, as shown in the embodiment of FIG. 4. As shown in FIG. 6, the secondary chamber 24 has a generally trapezoidal shaped cross-section with an open base that defines a first opening 24*a* between the secondary chamber 24 and an area surrounding the toilet. The secondary chamber 24 further includes a peripheral channel 24*c* (e.g., flange, recess, etc.) for receiving a cover 26 therein at the front of the secondary chamber 24. The cover 26 may be made from a vitreous material that is coupled to the secondary chamber 24 at the channel 24*c* (e.g., adhesively bonded, etc.). The cover 26 includes an opening 26*a* for receiving the sump jet 27 therein. The cover 26 is configured to interface with the connector assembly 28 to couple the sump jet 27 to the secondary chamber 24 in a substantially watertight manner. The secondary chamber 24 further includes a second base that defines a second opening 24*b* between the secondary chamber 24 and a sump 25 of the toilet. The sump jet 27 may be at least partially disposed in the second opening 24*b*, and is configured to be in fluid communication with the sump 25. The sump jet 27 is made from a non-vitreous material (e.g., plastic, metal, etc.) and may be coupled to, or integrally formed with, a portion of the connector assembly 28 (e.g., connector body 28*a*, etc.).

Referring to FIG. 7, a portion of the connector assembly 28 is shown in greater detail. The connector assembly 28 includes a connector body 28*a* having a generally hollow cylindrical shape. The connector body 28*a* includes a central opening 28*c* extending therethrough for directing fluid to the sump jet 27, which may be coupled to, or integrally formed with, the connector body 28*a*. The connector body 28*a* further includes a first portion 28*a*' having a plurality of threads disposed on an outer surface thereof, and a second portion 28*b* located opposite the first portion 28*a*'. As shown in FIG. 6, the first portion 28*a*' may include a flared end that defines a hose barb for fluidly coupling the connector body 28*a* to a fluid conduit (e.g., conduit 30, etc.). The second portion 28*b* gradually tapers radially away from the central opening 28*c* to define a generally frusto-conical shape with the widest portion located farthest away from the first portion 28*a*'. The connector assembly 28 further includes a sealing member 29 disposed around the connector body 28*a* between the first portion 28*a*' and the second portion 28*b*. The sealing member 29 includes a flange 29*a* and a body 29*b* extending from the flange 29*a*. The flange 29*a* extends radially away from the body 29*b* and is arranged to face toward the first portion 28*a*'. The body 29*b* has a generally hollow cylindrical shape and is arranged to face toward the second portion 28*b*. The connector assembly 28 further includes a nut 2 adjustably coupled to the first portion 28*a'*.

Still referring to FIG. 7, the connector assembly 28 is shown coupled to the cover 26 at the first opening 26*a*. The connector assembly 28 is positioned through the first opening 26*a* such that the flange 29*a* abuts a front vitreous surface of the cover 26*a*, and the body 29*b* is disposed at least partially into the first opening 26*a* between the cover 26 and the connector body 28*a*. The first portion 28*a*' is located in front of the cover 26 and the second portion 28*b* is located on an opposite side of the cover 26 that corresponds to, for example, an interior of the secondary chamber 24. The nut 2 may be tightened along the threads of the first portion 28*a*' until a trailing edge of the body 29*b* sufficiently engages the second portion 28*b*, so as to sandwich the sealing member 29 between the second portion 28*b* and the cover 26 to create a substantially watertight seal between the connector assembly 28 and the secondary chamber 24. In other words, the generally frusto-conical profile of the second portion 28*b* is urged toward the first opening 26*a* as the nut 2 is tightened on the first portion 28*a*', which causes the sealing member 29 to compress and expand radially between the cover 26 and the connector body 28*a* into the first opening 26*a*. In this manner, the connector assembly 28 can create a substantially watertight seal between the non-vitreous sump jet 27 and the vitreous toilet sump 25.

Figure 9:
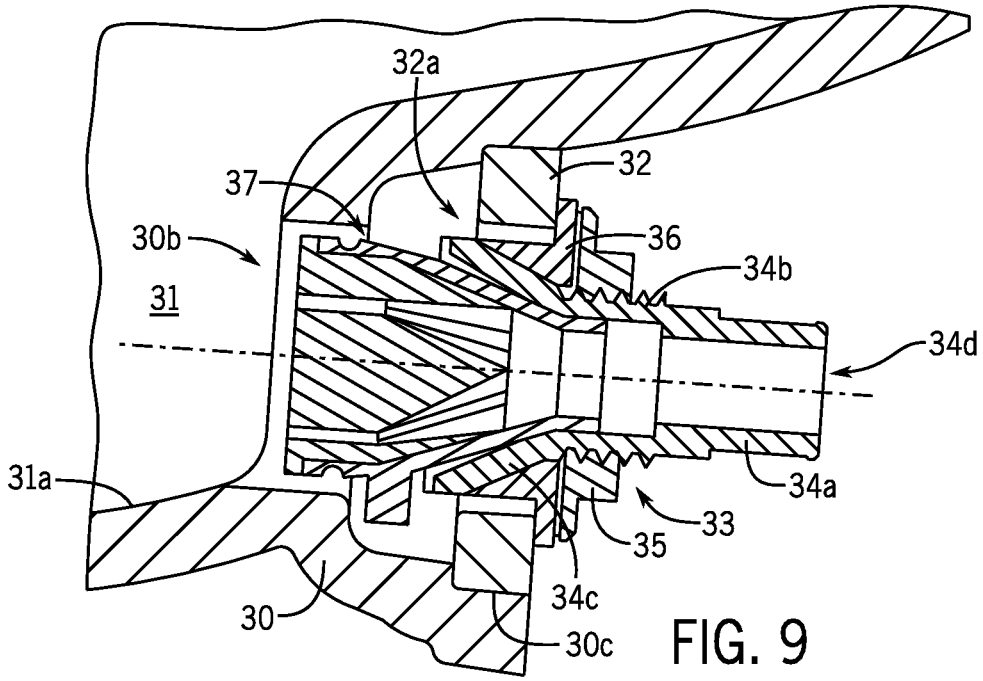
FIG. 9 is a partial cross-sectional view of a toilet assembly including a non-vitreous fluid delivery component coupled to a toilet according to another exemplary embodiment.

Referring to FIGS. 9-19, a non-vitreous fluid delivery component, shown as a sump jet 37, is coupled to a secondary chamber 30 of a toilet by a connector assembly 33, according to another exemplary embodiment. As shown in FIG. 9, the secondary chamber 30 has a similar configuration as the secondary chamber 24 shown in the embodiment of FIG. 6, but with a slightly different perimeter wall shape (i.e., a generally U-shaped cross-section). The secondary chamber 30 has an open front portion that defines a first opening 30*a* between the secondary chamber 30 and an area surrounding the toilet. The secondary chamber 30 further includes a peripheral channel 30*c* (e.g., flange, recess, etc.) for receiving a cover 32 therein. The cover 32 may be made from a vitreous material that is coupled to the secondary chamber 30 at the channel 30*c* (e.g., adhesively bonded, etc.). The cover 32 includes an opening 32*a* for receiving the sump jet 37 therein. The cover 32 is configured to interface with the connector assembly 33 to couple the sump jet 37 to the secondary chamber 30 in a substantially watertight manner. The secondary chamber 30 further includes a second opening 30*b* between the secondary chamber 30 and a sump 31 of the toilet. The sump jet 37 is at least partially disposed in the second opening 30*b*, and is configured to be in fluid communication with the sump 31. The sump jet 37 is made from a non-vitreous material (e.g., plastic, etc.) and may be coupled to, or integrally formed with, a portion of the connector assembly 33 (e.g., connector body 34, etc.).

Figure 10:
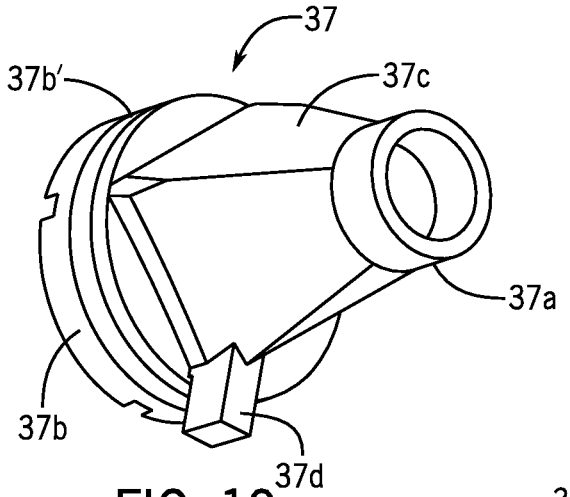
FIG. 10 is a perspective view of the non-vitreous fluid delivery component of FIG. 8.
Figure 11:
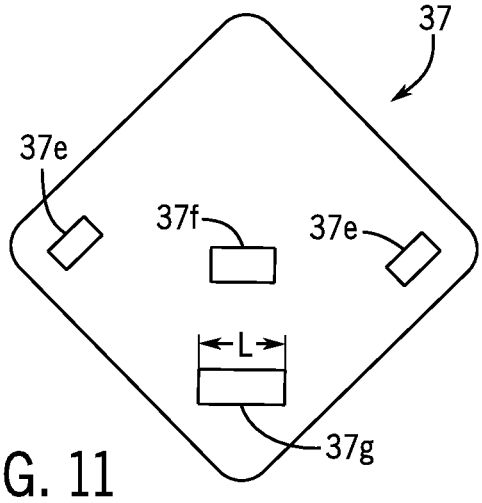
FIG. 11 is a partial front view of the non-vitreous fluid delivery component of FIG. 8.

In the exemplary embodiment shown in FIGS. 9-11, the sump jet 37 is shown as a separate component that is coupled to the connector assembly 33. The sump jet 37 includes an inlet portion 37*a* having a generally hollow cylindrical shape that defines an axis represented by a dashed line in FIG. 9. The sump jet 37 further includes an intermediate portion 37*c* extending from the inlet portion 37*a*. The intermediate portion 37*c* extends gradually outwardly from the inlet portion 37*a*, and has a generally rectangular cross-sectional shape taken along its width (see, for example, FIG. 11). The sump jet 37 further includes an outlet portion 37*b* extending from the intermediate portion 37*c*. The outlet portion 37*b* has a generally outer cylindrical shape, and includes a plurality of jet orifices (e.g., side jet orifices 37*e*, upper jet orifice 37*f*, lower jet orifice 37*g*, etc.) located at an interior of the third portion 37*b*. The plurality of jet orifices are each configured to receive a flow of water from the inlet portion 37*a* and to increase the velocity of the flow of water to the sump 31, so as to entrain a flow in the sump 31 and help to prime a siphon. The outlet portion 37*b* further includes an outer peripheral channel 37*b*' that is configured to receive a seal, such as an O-ring (e.g., O-ring 38 shown in FIG. 17, etc.), so as to create a seal between a vitreous portion of the secondary chamber 30 and the sump 31 at the second opening 30*b*.

As shown in the cross-sectional view of FIG. 11, which illustrates a cross-section of the intermediate portion 37*c*, the sump jet 37 is shown oriented at an installation position for coupling to the sump of the toilet (e.g., sump 21, etc.). As shown in FIG. 11, the sump jet 37 is oriented such that the plurality of jet orifices define a generally triangular shaped pattern. For example, the sump jet 37 includes a pair of side jet orifices 37*e* (e.g., first jet orifices, etc.) located at diagonally opposed first and second corners of the sump jet 37. The side jet orifices 37*e* have a generally rectangular shape, and are each oriented at an acute angle at the installation position shown in FIG. 11. That is to say, the side jet orifices 37*e* are oriented substantially parallel to the respective adjacent sides of the square cross-section of the intermediate portion 37*c*. Thus, when the sump jet 37 is oriented at the installation position shown in FIG. 11 (e.g., rotated 45 degrees from horizontal, etc.), the side jet orifices 37*e* are each oriented at an acute angle relative to horizontal (e.g., 45 degrees, etc.). The sump jet 37 further includes an upper jet orifice 37*f* (e.g., third jet orifice, etc.) located at a central portion of the sump jet between the side jet orifices 37*e*, and a lower jet orifice 37*g* (e.g., fourth jet orifice, etc.) located near a bottom corner, diagonally opposite from a top corner of the sump jet. The upper jet orifice 37*f* has a generally rectangular shape, and is oriented substantially horizontally (i.e., with its widest portion oriented parallel to horizontal) at the installation position shown in FIG. 11. The lower jet orifice 37*g* has a generally rectangular shape, and is also oriented substantially horizontally at the installation position. The various jet orifices may have other shapes (e.g., circular, etc.) and relative orientations, according to other exemplary embodiments. The lower jet orifice 37*g* has a length "L" that is longer than the lengths of the upper jet orifice 37*f* and the side jet orifices 37*e*, which is particularly advantageous in the embodiment shown in FIGS. 9-19.

Figure 12:
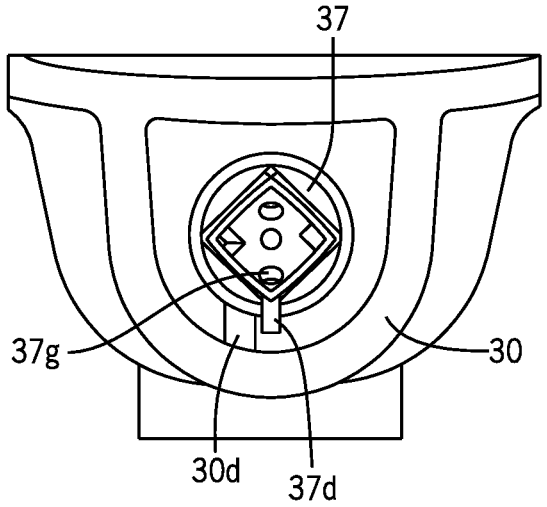
FIG. 12 is a partial front view of the assembly of FIG. 9 without a connector.

For example, as shown in FIGS. 9 and 12, the sump jet 37 is configured to be oriented relative to the sump 31, such that the lower jet orifice 37*g* can direct fluid toward a lower surface 31*a* of the sump 31. The lower surface 31*a* typically accumulates a larger amount of waste, as compared to other portions of the sump 31 (e.g., sidewall, upper wall, etc.), which can be difficult to remove from the sump 31 during a flush cycle. According to the exemplary embodiment shown, the lower jet orifice 37*g* has a length "L" that is longer than the length of the other jet orifices of the sump jet 37, such that water discharged by the lower jet orifice 37*g* is distributed (e.g., "fanned" out) across a larger surface area (e.g., wider) of the lower surface 31*a*, as compared to other areas of the sump 31, which can, advantageously, help to remove waste that may be present along the lower surface 31*a*.

Additionally, the upper jet orifice 37*f* is located closer to the lower jet orifice 37*g* (i.e., near a central portion of the sump jet above the lower jet orifice 37*g*), as compared to the relative distance between the two side jet orifices 37*e*, so as to direct additional fluid closer to the lower surface 31*a*. In this manner, the sump jet 37 can effectively remove waste that may be present along the lower surface 31*a* of the sump 31.

Figure 13:
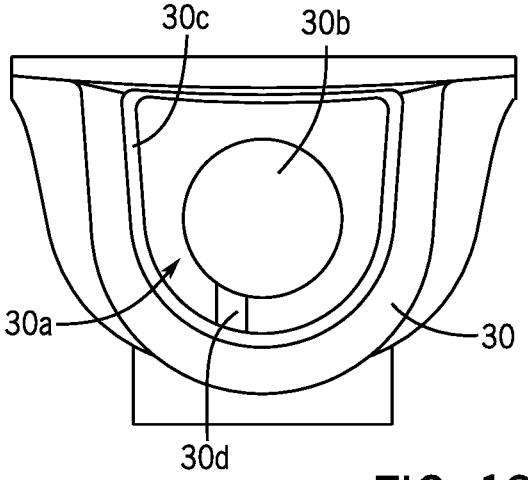
FIG. 13 is a partial front view of the toilet of FIG. 9.
Figure 14:
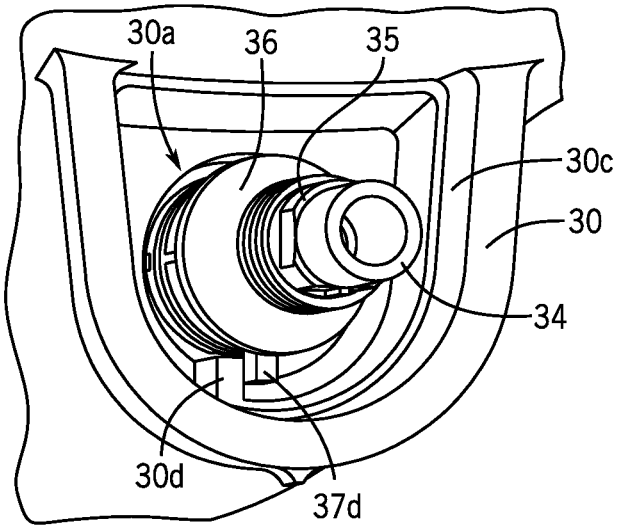
FIG. 14 is a partial perspective view of the assembly of FIG. 9 with a connector.
Figure 15:
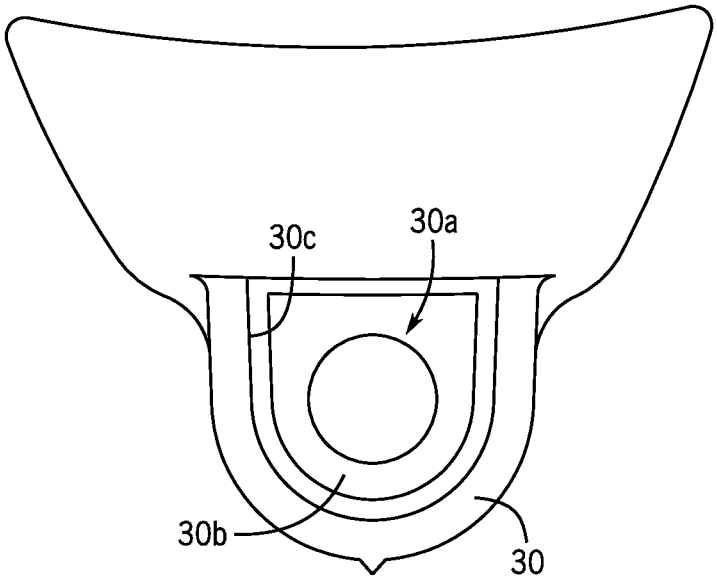
FIG. 15 is a front view of a prototype version of a portion of the toilet of FIG. 9.
Figure 16:
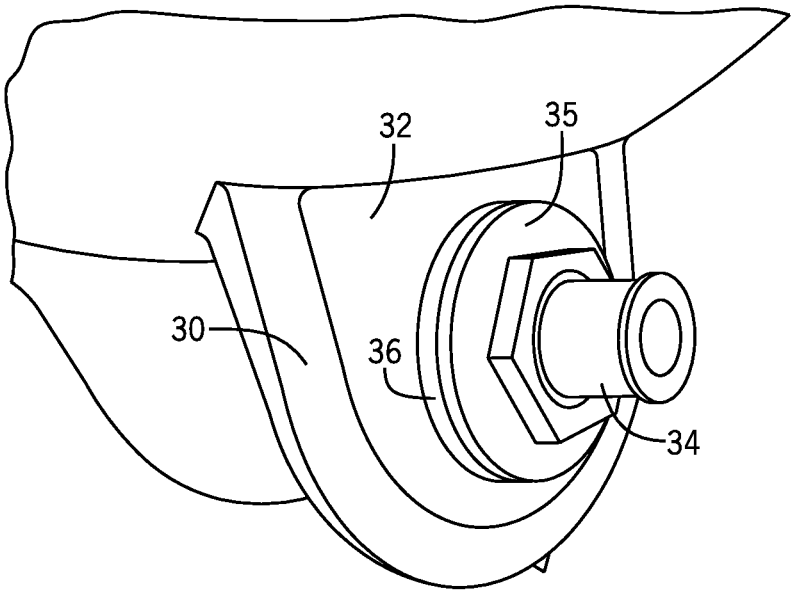
FIG. 16 is a perspective view of a prototype version of the assembly of FIG. 9.
Figure 17:
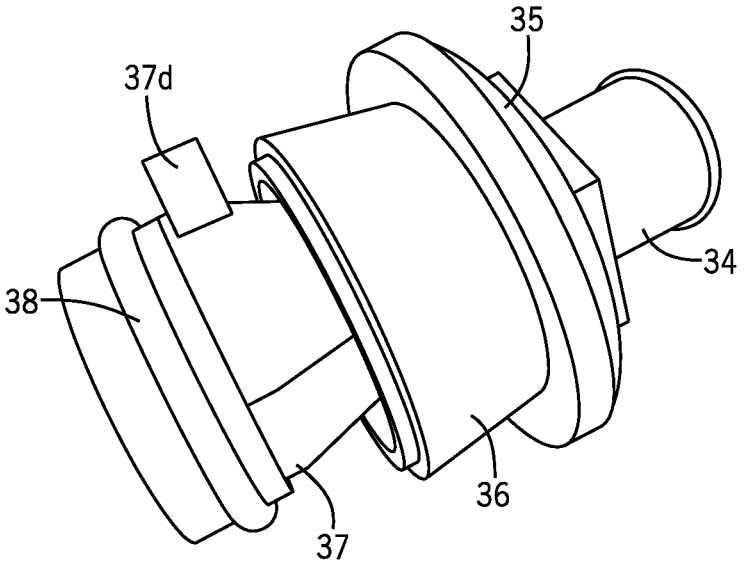
FIG. 17 is a perspective view of a prototype version of the non-vitreous fluid delivery component and connector of FIG. 9.
Figure 18:
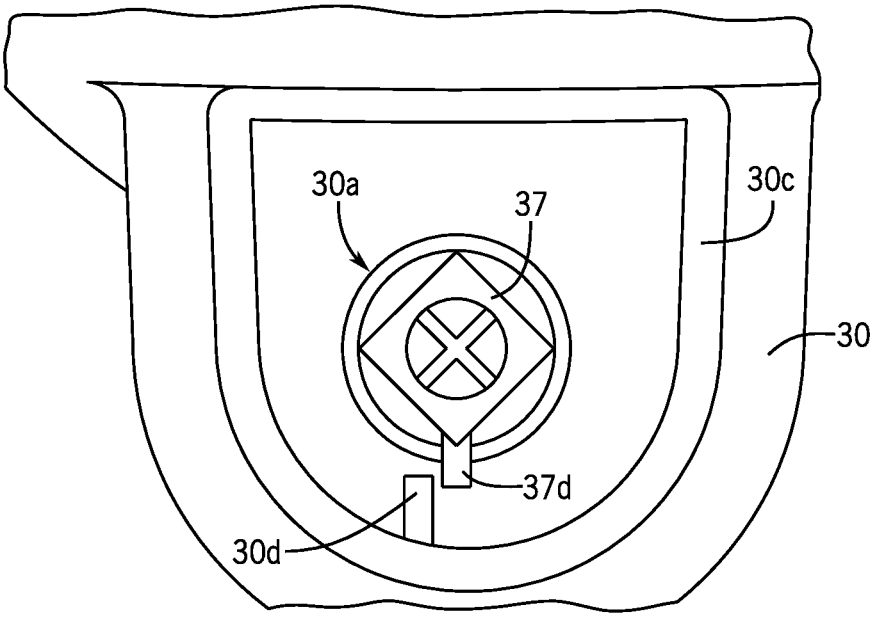
FIG. 18 is a partial front view of a prototype version of the assembly of FIG. 9 without a connector.
Figure 19:
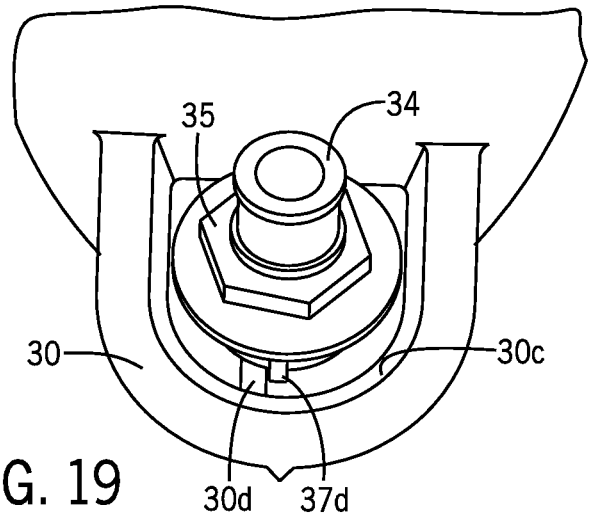
FIG. 19 is a partial front view of a prototype version of the assembly of FIG. 9 with a connector.

Referring to FIGS. 9-10 and 12-19, to maintain the installation position of the sump jet 37 shown in FIGS. 9 and 11, and thereby the position of the lower jet orifice 37*g* relative to the lower surface 31*a*, the sump jet 37 includes a first protrusion 37*d* extending outwardly from the sump jet 37 (e.g., the intermediate portion 37*c*, etc.) that is configured to engage a second protrusion 30*d* extending from an interior wall that defines part of the secondary chamber 30. For example, as shown in FIG. 13, the first protrusion 37*d* extends radially outwardly a sufficient distance to at least partially overlap the second protrusion 30*d* extending inwardly toward the center of the second opening 30*b*. Thus, during installation when the sump jet 37 is inserted through the first opening 32*a* and at least partially into the second opening 30*b*, the sump jet 37 can be rotated along an axis defined by the first opening 32*a* until the first protrusion 37*d* engages the second protrusion 30*d*. The first protrusion 37*d* and the second protrusion 30*d* are positioned such that when they engage each other, the sump jet 37 is oriented such that the lower jet orifice 37*g* is located nearest to the lower surface 31*a*, as shown in FIGS. 9 and 12. In this way, the first protrusion 37*d* and the second protrusion 30*d* can cooperate to maintain an orientation of the sump jet 37 relative to the sump 31.

Still referring to FIG. 9, the connector assembly 33 further includes a connector body 34 having a generally hollow cylindrical shape. The connector body 34 includes a central opening 34*d* extending therethrough for directing fluid to the sump jet 37, which may be coupled to, or integrally formed with, the connector body 34. The connector body 34 further includes a first portion 34*a* including a flared end that defines a hose barb for fluidly coupling to a fluid conduit (e.g., conduit 30, etc.). The connector body 34 further includes a second portion 34*b* extending from the first portion 34*a*. The second portion 34*b* has a generally hollow cylindrical shape, and includes a plurality of threads disposed on an outer surface thereof. The connector body 34 further includes a third portion 34*c* extending from the second portion 34*b*. The third portion 34*c* gradually tapers radially away from the central opening 34*d* to define a generally frusto-conical shape with the widest portion of the third portion 34*c* located farthest away from the first portion 34*a*. The connector assembly 33 further includes a sealing member 36 disposed around a portion of the connector body 34 (e.g., along the third portion 34*c*). The sealing member 36 includes a flange 36*a* and a body 36*b* extending from the flange 36*a*. The flange 36*a* extends radially away from the body 36*b* and is arranged to face toward the first portion 34*a*. The body 36*b* has a generally frusto-conical shape that is complementary to the third portion 34*c*. The body 36*b* is arranged to face toward the third portion 34*c*. The connector assembly 33 further includes a nut 35 adjustably coupled to the second portion 34*b*.

As shown in FIG. 9, the connector assembly 33 is coupled to the cover 32 at the first opening 32*a*. The connector assembly 33 is positioned through the first opening 32*a* such that the flange 36*a* abuts a front vitreous surface of the cover 32, and the body 36*b* is disposed at least partially into the first opening 32*a* between the cover 32 and the connector body 34. The first portion 34*a* and at least a portion of the second portion 34*b* are located in front of the cover 32. At least a portion of the third portion 34*c* is located on an opposite side of the cover 32 at an interior of the secondary chamber 30. The nut 35 may be tightened along the threads of the second portion 34*b* until the third portion 34*c* sufficiently engages the body 36*b*, so as to sandwich the sealing member 36 between the connector body 34 and the cover 32 to create a substantially watertight seal between the connector assembly 33 and a vitreous portion of the secondary chamber 30.

In other words, the frusto-conical profile of the third portion 34*c* is urged toward the first opening 32*a* as the nut 35 is tightened on the first portion 34*a*, which causes the sealing member 36 to compress and expand radially between the cover 32 and the connector body 34 into the first opening 32*a*. In this manner, the connector assembly 33 can create a substantially watertight seal between the sump jet 37 and the toilet sump 31. In addition, the orientation of the sump jet 37 relative to the sump 31 is maintained during coupling of the nut 35 to the connector body 34, because the first protrusion 37*d* is engaged with the second protrusion 30*d* on the secondary chamber 30, as explained above.

Figure 20:
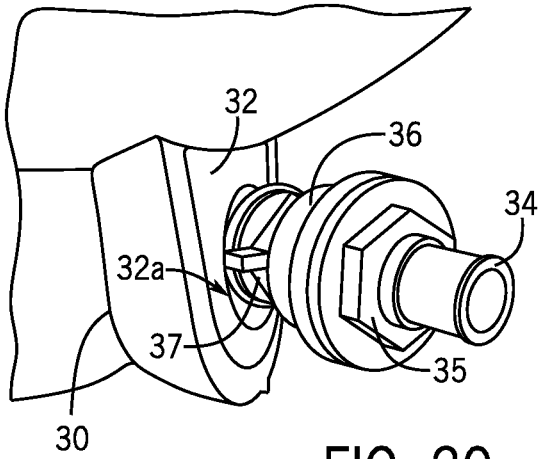
FIGS. 20-22 illustrate a method of assembling a prototype version of the non-vitreous fluid delivery component of FIG. 9 to a toilet according to another exemplary embodiment.
Figure 21:
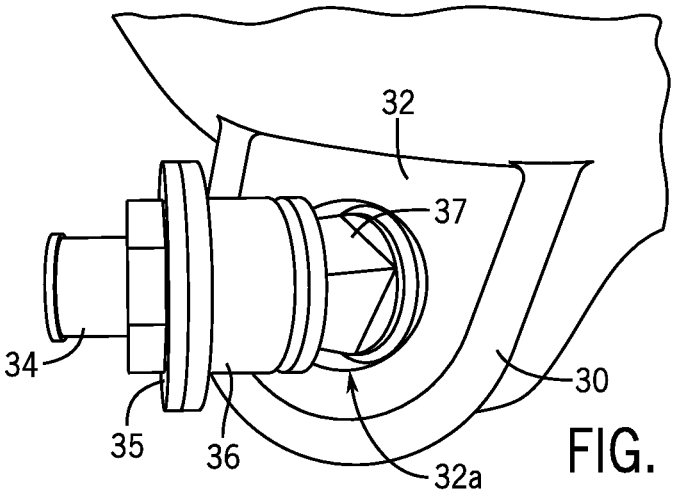
Figure 22:
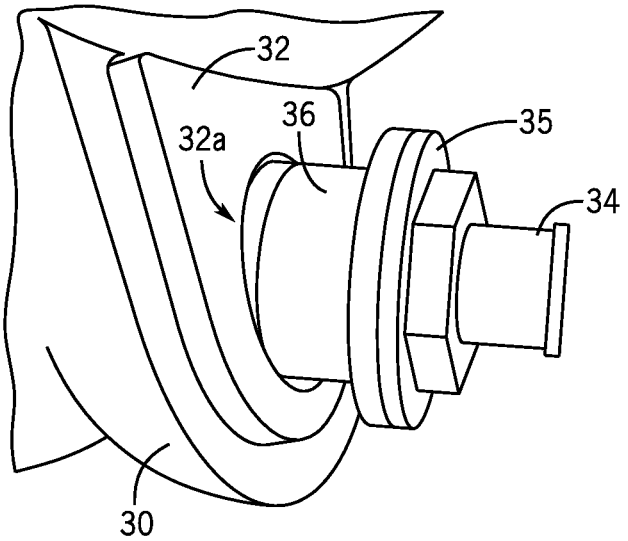

Referring to FIGS. 20-22, an exemplary installation sequence for the sump jet 37 is shown according to an exemplary embodiment. In a first step shown in FIGS. 20-22, the sump jet 37 is inserted into the first opening 32*a* of the cover 32 until the sealing member 36 engages a portion of the cover 32 at the opening 32*a*. In a second step, the sump jet 37 is rotated relative to the secondary chamber 30 until the first protrusion 37*d* engages the second protrusion 30*d* on a wall of the secondary chamber 30, so as to rotationally align the sump jet 37 relative to the toilet sump 31 (see, for example, FIG. 19). In a third step, the nut 35 is tightened along the threads of the second portion 34*b* until the third portion 34*c* of the connector body 34 sufficiently engages the body 36*b* of the sealing member 36, so as to sandwich the sealing member 36 between the connector body 34 and the cover 32 to create a substantially watertight seal between the connector assembly 33 and the secondary chamber 30. That is to say, the frusto-conical profile of the third portion 34*c* is urged toward the first opening 32*a* as the nut 35 is tightened on the first portion 34*a*, which causes the sealing member 36 to compress and expand radially between the cover 32 and the connector body 34 into the first opening 32*a*. In this manner, the connector assembly 33 can create a substantially watertight seal between the sump jet 37 and the toilet sump 31.

Figure 23:
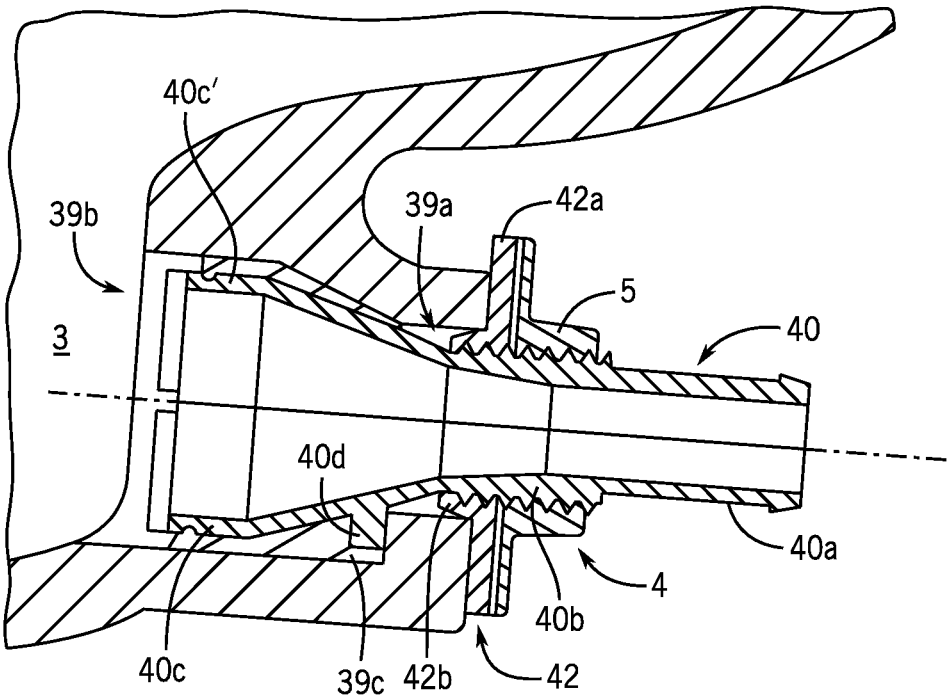
FIG. 23 is a partial cross-sectional view of a toilet assembly including a non-vitreous fluid delivery component coupled to a toilet according to another exemplary embodiment.

Referring to FIG. 23, a non-vitreous fluid delivery component, shown as a sump jet 40, is coupled to a secondary chamber 39 of a toilet by a connector assembly 4, according to another exemplary embodiment. In this exemplary embodiment, the secondary chamber 39 extends forward from a sump 3 of the toilet, and includes a first opening 39*a* between the secondary chamber 39 and an outer area surrounding the toilet. The first opening 39*a* is partially defined by a flange portion 39*c* extending radially inward toward the first opening 39*a*. The secondary chamber 39 further includes a second opening 39*b* between the secondary chamber 39 and the sump 3 of the toilet. The sump jet 40 may be at least partially disposed in, or positioned adjacent to, the second opening 39*b*, and is configured to be in fluid communication with the sump 3. The sump jet 40 is made from a non-vitreous material (e.g., plastic, metal, etc.) and may be coupled to, or integrally formed with, a portion of the connector assembly 4 (e.g., sealing member 42, nut 5, etc.).

Still referring to FIG. 23, the connector assembly 4 comprises a nut 5 that is threadably coupled to a portion of the sump jet 40 (e.g., second portion 40*b*, discussed in greater detail below). The connector assembly 4 further comprises a sealing member 42 (e.g., a spud seal, a flange seal, etc.) disposed between the nut 5 and a vitreous portion of the secondary chamber 39. The sealing member 42 includes a flange 42*a* and a body 42*b* extending from the flange 42*a*. The flange 42*a* is configured to engage an outer vitreous surface of the toilet that defines part of the secondary chamber 39. The body 42*b* extends at least partially into the first opening 39*a* of the secondary chamber 39, and is configured to engage a vitreous portion of the secondary chamber that defines the first opening 39*a*. The sealing member 42 is configured to create a substantially watertight seal between the sump jet 40 and a vitreous portion of the secondary chamber 39.

The sump jet 40 includes a first portion 40*a* having a generally hollow cylindrical shape that defines a central channel having an axis represented by a dashed line in FIG. 23. The first portion 40*a* further includes a flared end that defines a hose barb configured to couple to, and be in fluid communication with, a fluid conduit (e.g., conduit 30, etc.). The sump jet 40 further includes a second portion 40*b* extending from the first portion 40*a*. The second portion 40*b* includes a plurality of threads disposed on an outer surface thereof for threadably engaging corresponding threads on the nut 5. The sump jet 21 further includes a third portion 40*c* extending from the second portion 40*b*. The third portion 40*c* includes one or more jet orifices in fluid communication with the central channel for introducing a flow of water from a water source into the sump 11. According to an exemplary embodiment, the sump jet 40 may be configured to have the same jet orifice configuration as the sump jet 37 discussed above. According to other exemplary embodiments, the sump jet 40 may have a different jet orifice configuration. The third portion 40*c* gradually increases in diameter from the second portion 40*b*, so as to define an outer surface profile that has a generally frusto-conical shape. The third portion 40*c* includes a channel 40*c*' extending along an outer periphery thereof for receiving a seal (e.g., an O-ring, etc.), so as to create a seal between the third portion 40*c* and a vitreous portion of the secondary chamber 39 that defines the second opening 39*b*. The sump jet 40 further includes a protrusion 40*d* extending radially outwardly away from sump jet 40. The protrusion 40*d* is configured to engage an inner surface of the flange portion 39*c* within the secondary chamber, so as to facilitate coupling of the sump jet 40 to the secondary chamber 39.

For example, still referring to FIG. 23, the sump jet 40 is shown with the third portion 40*c* at least partially disposed in the second opening 39*b* between the secondary chamber 39 and the sump 3. The second portion 40*b* is disposed at least partially into the first opening 39*a* between the secondary chamber 39 and an outer vitreous surface of the toilet. The sealing member 42 is disposed around the second portion 40*b* in front of the secondary chamber 39 adjacent the first opening 39*a*, with the body 42*b* facing toward the third portion 40*c* and the flange 42*a* facing toward the first portion 40*a*. The sump jet 40 may be inserted into the secondary chamber 39 such that the second portion 40*b* extends partially into the first opening 39*a* with the protrusion 40*d* located within the secondary chamber 39 adjacent an inner surface of the flange portion 39*c*. The sealing member 42 may be positioned such that the body 42*b* is inserted at least partially into the first opening 39*a* between the second portion 40*b* and the secondary chamber 39. The flange 42*a* may be sealingly engaged with an outer vitreous surface of the secondary chamber 39 adjacent the first opening 12*a*. The nut 5 may be threadably coupled to the second portion 40*b* extending in front of the secondary chamber 39 and abutting the flange 42*a*. The nut 5 may be tightened against the flange 42*a* and the vitreous portion of the secondary chamber 39 until the protrusion 40*d* sufficiently engages the flange portion 39*c*, so as to sandwich the sealing member 42 between the sump jet 40 and the vitreous portion of the secondary chamber 39 to create a substantially watertight seal between the sump jet 40 and the secondary chamber 39.

Figure 24:
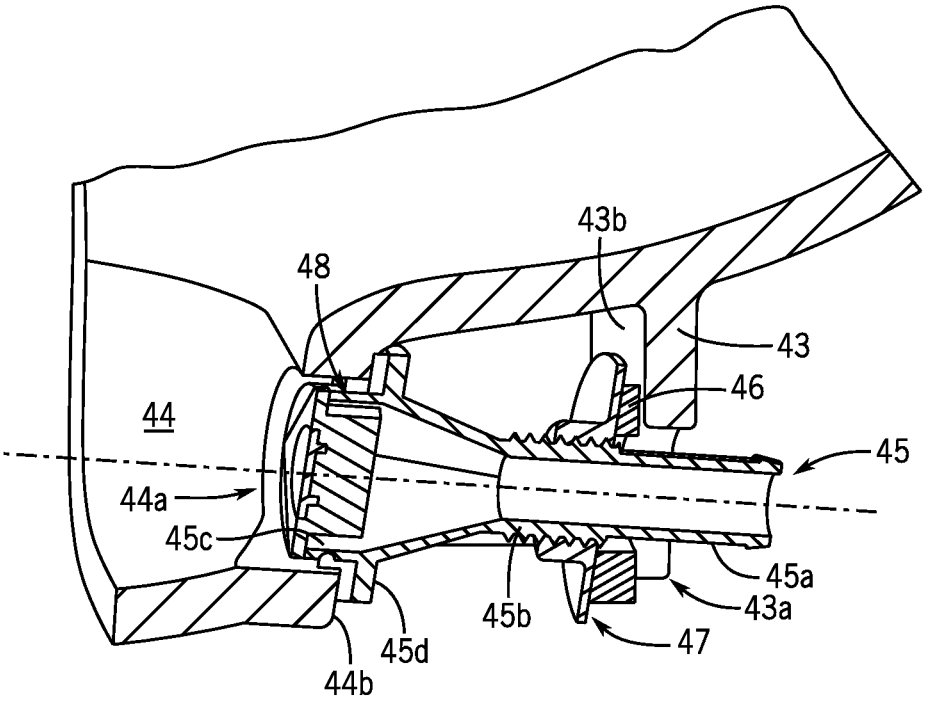
FIG. 24 is a partial cross-sectional view of a toilet assembly including a non-vitreous fluid delivery component coupled to a toilet according to another exemplary embodiment.

Referring to FIG. 24, a non-vitreous fluid delivery component, shown as a sump jet 45, is coupled to a sump 44 of a toilet by a connector assembly 6, according to another exemplary embodiment. In this exemplary embodiment, the sump 44 includes an opening 44*a* for receiving a portion of the sump jet 45 (e.g., third portion 45*c*). The toilet further includes an outer wall 43 extending in front of the opening 44*a* that includes a slot 43*a* for receiving an opposite portion of the sump jet 45 (e.g., first portion 45*a*), the details of which are discussed below. The sump jet 45 may be at least partially disposed in the opening 44*a*, and is configured to be in fluid communication with the sump 44. The sump jet 45 is made from a non-vitreous material (e.g., plastic, metal, etc.) and may be coupled to, or integrally formed with, a portion of the connector assembly 6 (e.g., sealing member 46, nut 47, etc.).

Still referring to FIG. 24, the connector assembly 6 comprises a nut 46 that is threadably coupled to a portion of the sump jet 45 (e.g., second portion 45*b*, discussed in greater detail below). The connector assembly 6 further comprises a sealing member 46 disposed between the nut 47 and an inner surface 43*b* of the outer wall 43. The sealing member 46 has a wedge shape to facilitate coupling of the sump jet 45 to the toilet and maintaining an axial position of the sump jet 45 relative to the opening 44*a* of the sump 44. For example, the sump jet 45 includes a first portion 45*a* having a generally hollow cylindrical shape that defines a central channel extending along an axis represented by a dashed line in FIG. 24. The first portion 45*a* further includes a flared end that defines a hose barb configured to couple to, and be in fluid communication with, a fluid conduit (e.g., conduit 30, etc.). The sump jet 45 further includes a second portion 45*b* extending from the first portion 45*a*. The second portion 45*b* includes a plurality of threads disposed on an outer surface thereof for threadably engaging corresponding threads on the nut 47. The sump jet 45 further includes a third portion 45*c* extending from the second portion 45*b*. The third portion 45*c* includes one or more jet orifices in fluid communication with the central channel for introducing a flow of water from a water source into the sump 44. The third portion 45*c* gradually increases in diameter from the second portion 45*b*, so as to define an outer surface profile that has a generally frusto-conical shape. The third portion 45*c* includes a channel 45*c'* extending along an outer periphery thereof for receiving a seal 48 that is configured to sealingly engage an outer surface 44*b* of the sump 44 adjacent the opening 44*a*, so as to create a substantially watertight seal between the sump jet 45 and the sump 44. The sump jet 45 further includes a flange 45*d* extending radially outwardly away from the sump jet 45 between the channel 45*c* and the second portion 45*b*. The flange 45*d* is configured to engage a portion of the seal 48, so as to sandwich the seal 48 between the outer surface 44*b* and the flange 45*d* to facilitate coupling of the sump jet 40 to the sump 44.

Still referring to FIG. 24, the sump jet 45 is shown with the third portion 45*c* at least partially disposed in the opening 44*a*. The second portion 45*b* is disposed between the outer surface 44*b* and the inner surface 43*b* of the wall 43, which faces the outer surface 44*b*. The sealing member 46 is disposed around the second portion 45*b* and is configured to engage the inner surface 43*b* adjacent the slot 43*a*. The third portion 45*c* of the sump jet 45 may be at least partially inserted into the opening 44*a* with the seal 48 engaged with the outer surface 44*b*. The first portion 45*c* of the sump jet 45 may be inserted into the slot 43*a* with the sealing member 46 engaged with the inner surface 43*b*. The nut 47 may be threadably coupled to the second portion 45*b* adjacent the sealing member 46 prior to inserting the sump jet 45 into the opening 44*a*. Once the sump jet 45 is inserted, the nut 46 may be tightened against the sealing member 46 and the inner surface 43*b* until the flange 45*d* sufficiently engages the seal 48 against the outer surface 44*b*, so as to sandwich/compress the seal 48 between the sump jet 45 and the vitreous outer surface 44*b* to create a substantially watertight seal between the sump jet 45 and the sump 44.

In other words, the sump jet 45 is urged toward the sump 44 as the nut 47 is tightened against the sealing member 46 and the inner surface 43*b*, thereby increasing the pressure exerted by the flange 45*d* against the seal 48 and the outer surface 44*b* to help to create a substantially watertight seal at the sump 44. The wedge shape of the sealing member 46 can, advantageously, help to maintain an axial position of the sump jet 45 during tightening of the nut 47, such that the sump jet 45 is not disengaged from the wall 43 through the slot 43*a*.

Figure 25:
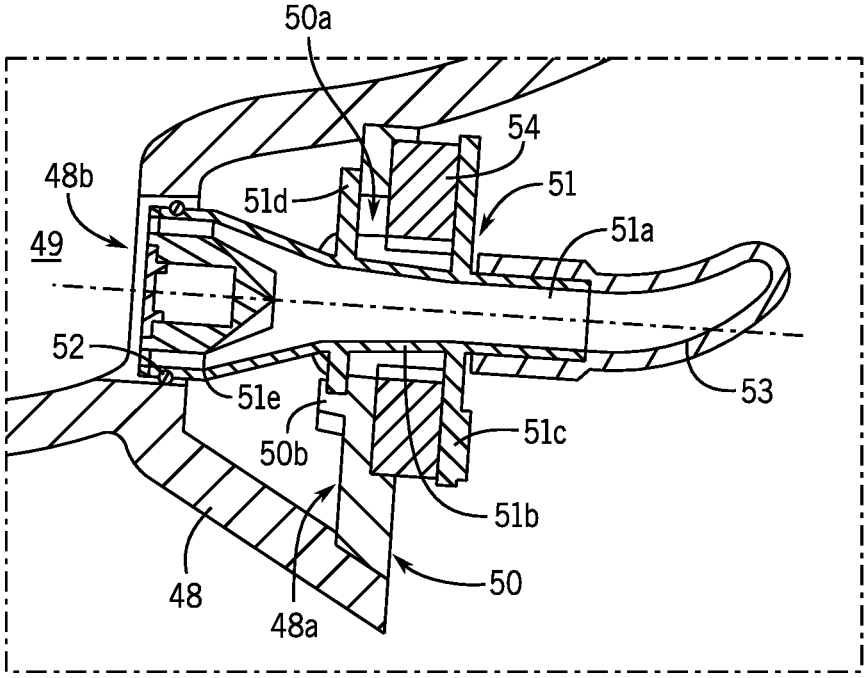
FIG. 25 is a partial cross-sectional view of a toilet assembly including a non-vitreous fluid delivery component coupled to a toilet according to another exemplary embodiment.
Figure 26:
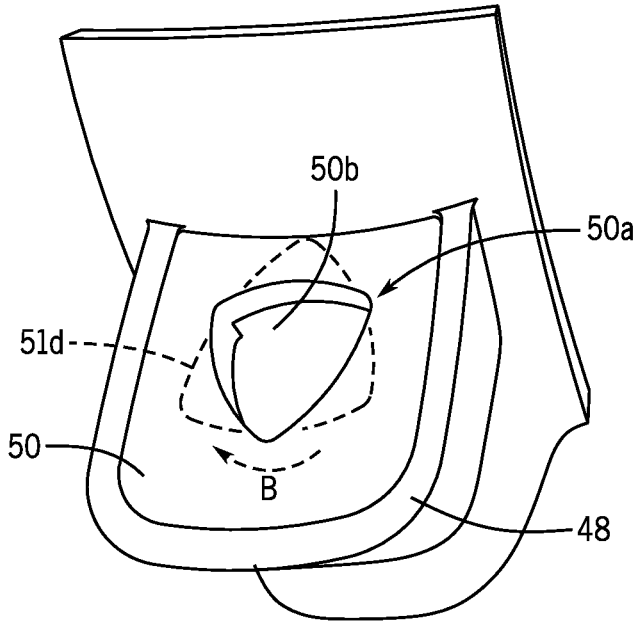
FIG. 26 is a perspective view of a prototype version of the toilet of FIG. 25, which illustrates an exemplary installation of the non-vitreous fluid delivery component.

Referring to FIGS. 25-26, a non-vitreous fluid delivery component, shown as a sump jet 51, is coupled to a secondary chamber 48 of a toilet, according to another exemplary embodiment. In this exemplary embodiment, the secondary chamber 48 has a generally trapezoidal shaped cross-section with an open base that defines a first opening 48*a* between the secondary chamber 48 and an area surrounding the toilet. The secondary chamber 24 further includes a peripheral channel 48*c* (e.g., flange, recess, etc.) for receiving a cover 50 therein. The cover 50 may be made from a vitreous material that is coupled to the secondary chamber 48 at the channel 48*c* (e.g., adhesively bonded, etc.). The cover 50 includes an opening 50*a* for receiving the sump jet 51 therein. The cover 50 is configured to interface with a portion of the sump jet 51 and a sealing member 54 to provide a substantially watertight seal with the secondary chamber 48. The secondary chamber 48 further includes a second base that defines a second opening 48*b* between the secondary chamber 48 and a sump 49 of the toilet. The sump jet 51 may be at least partially disposed in the second opening 48*b*, and is configured to be in fluid communication with the sump 49. The sump jet 51 is made from a non-vitreous material (e.g., plastic, metal, etc.) and includes integrated features that cooperatively define a connector for coupling to the cover 50, the details of which are described in the paragraphs that follow.

Still referring to FIG. 25, the sump jet 51 includes an inlet portion 51*a* having a generally hollow cylindrical shape that defines a central channel having an axis represented by a dashed line in FIG. 25. The inlet portion 51*a* is fluidly coupled to a water source, such as a household water supply, by a conduit 53. The sump jet 51 further includes an intermediate portion 51*b* extending from the inlet portion 51*a*. The intermediate portion 51*b* extends gradually outwardly from the inlet portion 51*a* and includes an outer wall 51*c* (e.g., first wall, outer flange, etc.) extending radially outwardly from a proximal end of the intermediate portion 51*b* nearest the inlet portion 51*a*. The intermediate portion 51*b* further includes an inner wall 51*d* (e.g., second wall, inner flange, etc.) extending radially outwardly from a distal end of the intermediate portion 51*b* that is located farther from the inlet portion 51*a* than the outer wall 51*c*. The inner wall 51*d* and the outer wall 51*c* are oriented substantially parallel to each other, and are configured to cooperate together to couple the sump jet 51 to the cover 50 in a substantially watertight manner, the details of which are discussed below. The sump jet 51 further includes an outlet portion 51*e* extending from the intermediate portion 51*b*. The outlet portion 51*e* extends gradually radially outwardly from the intermediate portion 51*b* to define a generally frusto-conical shape. The outlet portion 51*e* includes a plurality of channels that each define a jet orifice that is configured to receive a flow of water from the inlet portion 51*a* and to increase the velocity of the flow of water to the sump 49, so as to help to prime a siphon in the toilet. The outlet portion 51*e* further includes an outer peripheral channel 51*e*' that receives a seal, shown as an O-ring 52, so as to create a seal between a vitreous portion of the secondary chamber 48 and the sump 49 at the second opening 48*b*.

Still referring to FIGS. 25-26, a sealing member 54 is coupled to the sump jet 51 at the intermediate portion 51*b* between the outer wall 51*c* and the inner wall 51*d*. The sealing member 54 is configured to be disposed in front of the cover 50 at an outer facing surface of the cover. The sealing member 54 is configured to sealingly engage the outer facing surface of the cover 50 by an interference condition created between the cover 50 and the sump jet 51, so as to create a substantially watertight seal between the cover 50 and the sump jet 51. For example, the cover 50 includes a rear portion 50*b* that defines one or more slots or receiving channels (e.g., circumferential slots, etc.) disposed adjacent the opening 50*a* for receiving a complementary portion of the inner wall 51*d* when the sump jet 51 is coupled to the cover 50. The sump jet 51 may be coupled to the cover 50 by inserting the third portion 51*e* through the opening 50*a* such that the inner wall 51*d* is disposed through the opening 50*a* adjacent the rear portion 50*b*. The sump jet 51 may be rotated about an axis defined by the opening 50*a* until the complementary portion of the inner wall 51*d* is sufficiently received in the one or more receiving channels of the rear portion 50*b*. The rear portion 50*b* may include integrated stop features for defining a rotational endpoint for the complementary portion of the inner wall 51*d*, so as to define a fixed rotational position of the sump jet 51 (e.g., a twist-and-lock interface).

According to the exemplary embodiment shown in FIG. 26, the inner wall 51*d* may have a generally triangular shaped profile that defines three flanges or lobes (e.g., similar to the rotor of a Wankel engine) configured to be received in corresponding slots or receiving channels defined by the rear portion 50*b* of the cover 50. Similarly, the cover 50 may include a complementary shaped opening 50*a* for receiving the inner wall 51*d* therethrough. The sump jet 51 may be rotated in a direction indicated generally by arrow "B" in FIG. 26 until the flanges or lobes are received in the corresponding receiving channels defined by the rear portion 50*b*. According to other exemplary embodiments, the inner wall 51*d* may be configured to have more or fewer than three flanges or lobes, and the rear portion 50*b* may have a corresponding number of receiving channels.

As shown in FIG. 25, the sealing member 54 may be disposed on the sump jet 51 when the sump jet 51 is inserted through the opening 50*a* of the cover 50, such that the sealing member 54 engages the outer facing surface of the cover 50. The combined thickness of the sealing member 54 and the cover 50 is greater than the spacing between the inner wall 51*d* and the outer wall 51*c*, such that the sealing member 54 is compressed against the cover 50 by the outer wall 51*c* when the complementary features of the inner wall 51*d* are engaged with the receiving channels of the rear portion 50*b*. Thus, the outer wall 51*c* and the inner wall 51*d* cooperate with the cover 50 to create an interference condition with the sealing member 54 that provides a substantially watertight seal between the sump jet 51 and the cover 50.

Referring to FIGS. 27-31, a non-vitreous fluid delivery component, shown as a sump jet 57, is coupled to a secondary chamber 55 of a toilet, according to another exemplary embodiment. In this exemplary embodiment, the secondary chamber 55 has a generally hollow cylindrical shape that defines a first opening 55*a* between the secondary chamber 55 and an outer area surrounding the toilet. The secondary chamber 55 further includes a second opening 55*b* (shown in FIG. 31) between the secondary chamber 55 and a sump 56 of the toilet. The sump jet 57 may be at least partially disposed in the second opening 55*b*, and is configured to be in fluid communication with the sump 56. The sump jet 57 is made from a non-vitreous material (e.g., plastic, metal, etc.) and includes integrated features that cooperatively define a connector for coupling to the secondary chamber 55 in a substantially watertight manner, the details of which are described in the paragraphs that follow.

Figure 29:
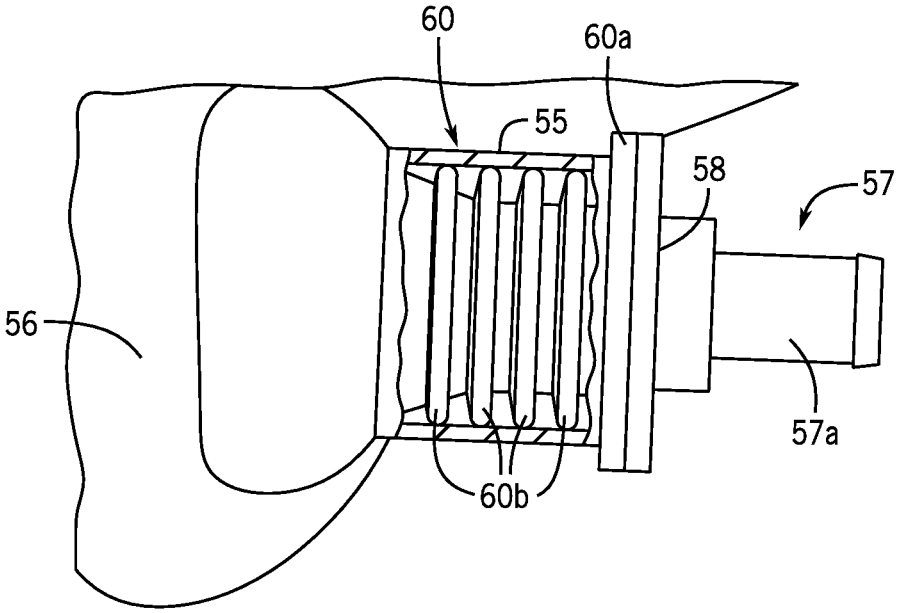
FIG. 29 is a partial perspective view of a prototype version of the toilet assembly of FIG. 27 including a transparent portion to illustrate a seal interface between a sealing member of the non-vitreous fluid delivery component and a portion of a toilet.
Figure 30:
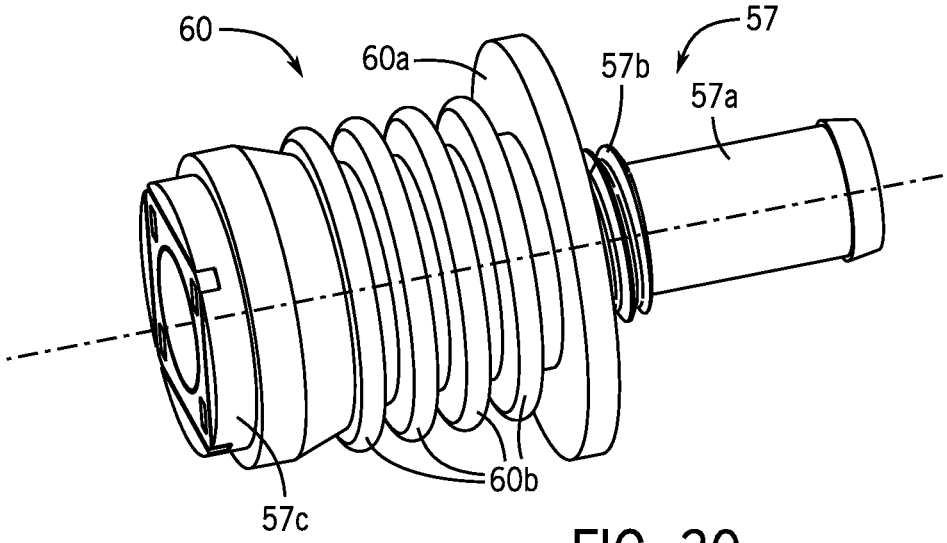
FIG. 30 is a perspective view of the non-vitreous fluid delivery component of FIG. 27.
Figure 31:
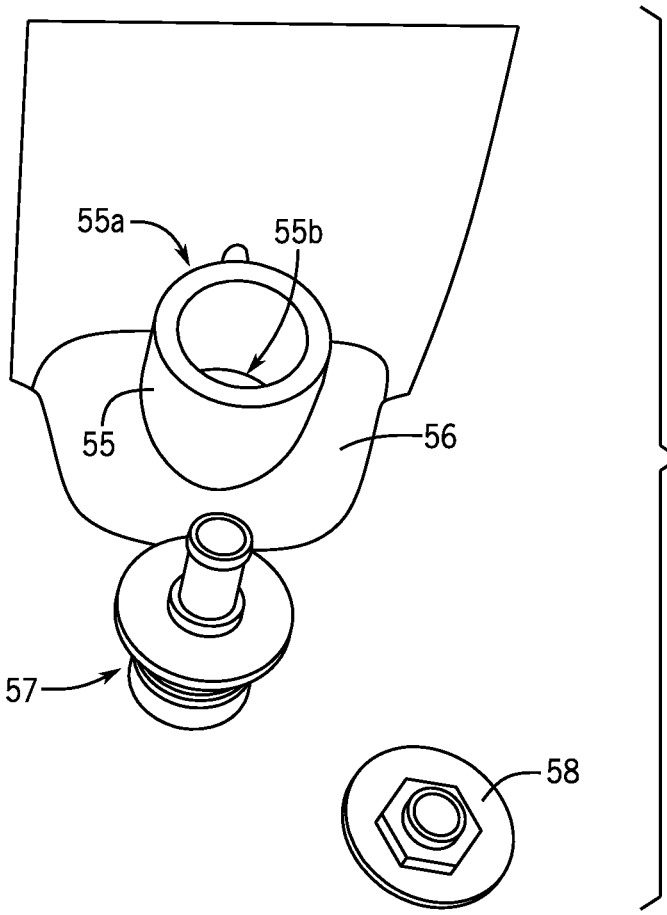
FIG. 31 is an exploded view of a prototype version of the toilet assembly of FIG. 27.

Referring to FIGS. 29-30, the sump jet 57 includes an inlet portion 57*a* having a generally hollow cylindrical shape that defines a central channel having an axis represented by a dashed line in FIG. 30. The inlet portion 57*a* further includes a flared end that defines a hose barb configured to couple to, and be in fluid communication with, a fluid conduit (e.g., conduit 30, etc.). The sump jet 57 further includes an intermediate portion 57*b* extending from the inlet portion 57*a*. The intermediate portion 57*b* includes a plurality of threads disposed on an outer surface thereof for threadably engaging corresponding threads on a nut 58. The sump jet 57 further includes an outlet portion 57*c* extending from the intermediate portion 57*b*. The outlet portion 57*c* extends gradually radially outwardly away from the central axis moving from the intermediate portion 57*b*, so as to define a generally frusto-conical shape. The outlet portion 57*c* further includes one or more jet orifices in fluid communication with the central channel for introducing a flow of water from a water source into the sump 56. According to an exemplary embodiment, the sump jet 57 may be configured to have the same jet orifice configuration as the sump jet 37 discussed above. According to other exemplary embodiments, the sump jet 57 may have a different jet orifice configuration. The outlet portion 57*c* is configured to receive a sealing member 60 around an outer surface thereof so as to create a substantially watertight seal with a vitreous portion of the secondary chamber 55. According to another exemplary embodiment, the sealing member 60 is integrally formed with the sump jet 57.

Figure 27:
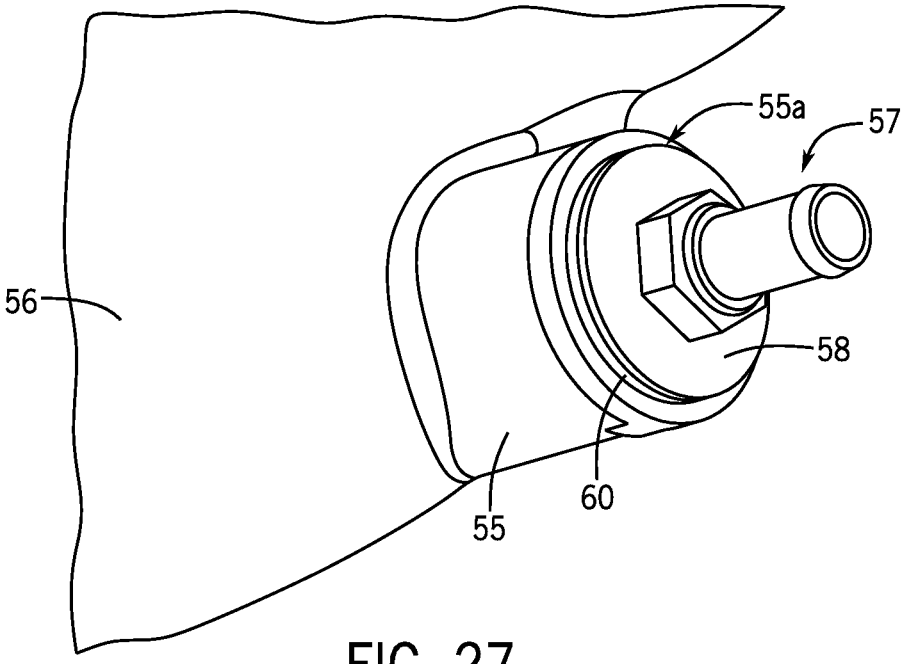
FIG. 27 is a partial perspective view of a toilet assembly including a non-vitreous fluid delivery component coupled to a toilet according to another exemplary embodiment.
Figure 28:
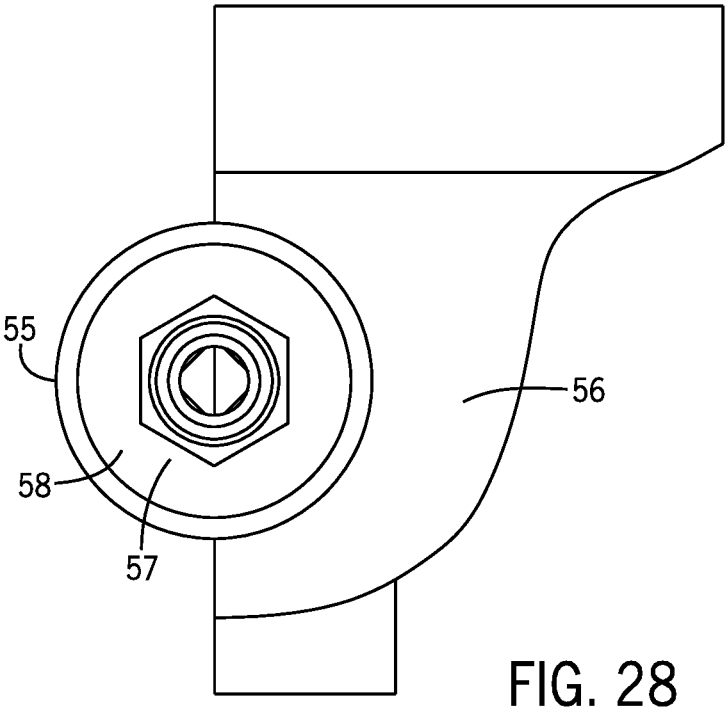
FIG. 28 is a partial front view of the toilet assembly of FIG. 27.

Still referring to FIGS. 29-30, the sealing member 60 has a generally outer cylindrical shape. The sealing member 60 includes a flange 60*a* that is configured to sealingly engage an outer vitreous surface of the secondary chamber 55 adjacent the first opening 55*a*. The sealing member 60 further includes a plurality of ribs 60*b* spaced apart from each other and extending circumferentially about the sealing member 60. The ribs 60*b* are each configured to expand radially outwardly away from the central axis when the sealing member 60 is compressed, such that the ribs 60*b* can engage an inner vitreous surface of the secondary chamber 55 to create a substantially watertight seal therebetween. For example, as shown in FIGS. 27 and 29, the sump jet 57 is arranged with the sealing member 60 disposed thereon such that the flange 60*a* is positioned between the plurality of threads on the intermediate portion 57*b* and the outlet portion 57*c*. The sump jet 57 may be inserted into the first opening 55*a* until a rear portion of the flange 60*a* engages an outer vitreous surface of the sump 55 adjacent the first opening 55*a*. A nut 58 may be threadably coupled to the intermediate portion 57*b* and may be tightened against the flange 60*a*. As the nut 58 is tightened along the threads of the intermediate portion 57*b*, the outlet portion 57*c* is urged toward the first opening 55*a*, which causes the plurality of ribs 60*b* to expand radially outwardly away from the central axis. In other words, the frusto-conical profile of the outlet portion 57*c* causes the sealing member 60 to compress and expand radially outwardly between the nut 58 and the third portion 57*c* as the nut 58 is tightened along the intermediate portion 57*b*. The nut 58 may be tightened until the plurality of ribs 60*b* sufficiently sealingly engage an inner vitreous surface of the secondary chamber 55, so as to create a substantially watertight seal between the sump jet 57 and the secondary chamber 55.

Figure 32:
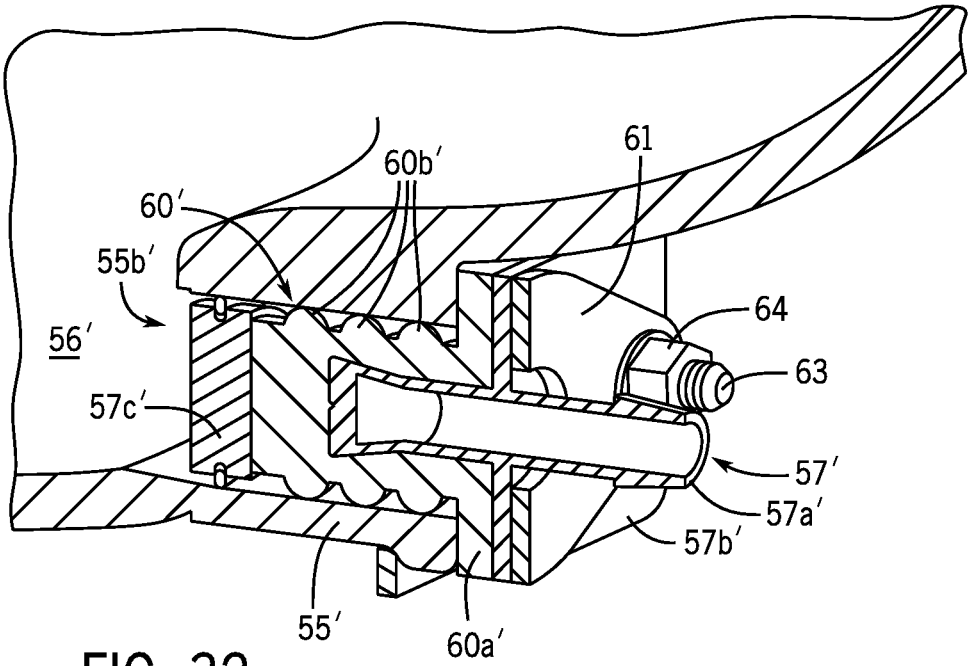
FIG. 32 is a partial cross-sectional view of a toilet assembly including a non-vitreous fluid delivery component coupled to a toilet according to another exemplary embodiment.
Figure 33:
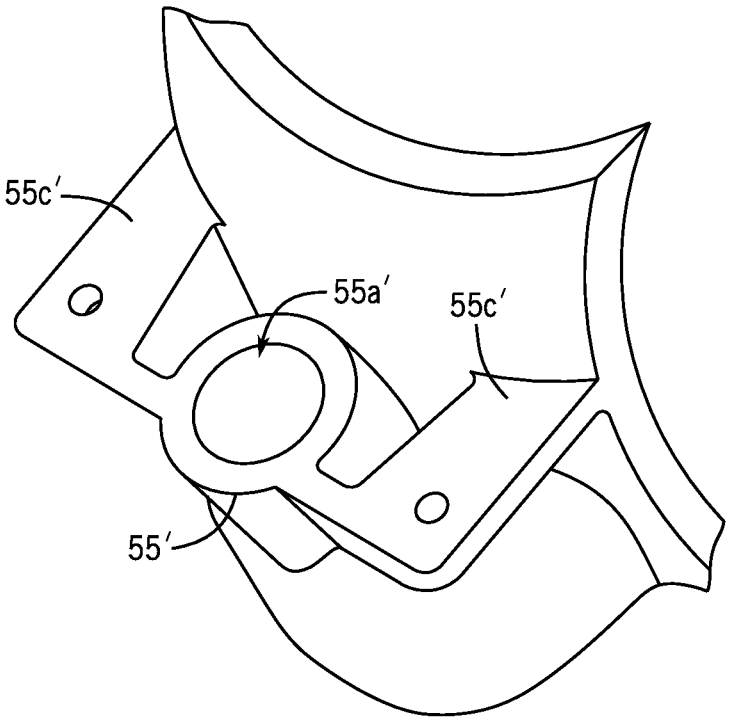
FIG. 33 is a partial perspective view of the toilet of FIG. 32.

Referring to FIGS. 32-35, a non-vitreous fluid delivery component, shown as a sump jet 57', is coupled to a secondary chamber 55' of a toilet, according to another exemplary embodiment. In this exemplary embodiment, the sump jet 57', the secondary chamber 55', and sealing member 60' are configured to be substantially the same as the corresponding elements in the embodiment of FIGS. 27-31. In this exemplary embodiment, however, the intermediate portion 57*b'* of the sump jet 57 includes a flange for coupling to lateral flanges 55*c* extending from the secondary chamber 55' adjacent the first opening 55*a'*, instead of outer threads that are threadably engaged by a nut. In addition, the plurality of ribs 60*b'* of the sealing member 60' are sized to engage an inner vitreous surface of the secondary chamber 55' without having to expand radially outwardly in response to relative movement of the sump jet. In this embodiment, the ribs 60*b'* primarily function to axially align the sump jet 57' relative to the first opening 55*a'*. As shown in FIGS. 32-34, a separate outer flange 61 sandwiches the flange of the sump jet 57 and the flange 60*a'* of the sealing member 60' between the outer flange 61 and the lateral flanges 55*c* of the sump. Each of the lateral flanges 55*c*, the sump jet flange, the flange 60*a'* of the sealing member, and the outer flange 61 includes a through hole for receiving a bolt 63 therethrough. A nut 64 may be threadably coupled to a threaded end of the bolt 63 to compress the flange 60*a'* against an outer vitreous surface of the secondary chamber 55' and the lateral flanges 55*c*, such that the sealing member 60' sealingly engages the vitreous surfaces of the secondary chamber 55' and the lateral flanges 55*c*. In this manner, the sump jet 57' can be coupled to the secondary chamber 55' in a substantially watertight manner.

Referring to FIGS. 36-42, a non-vitreous fluid delivery component, shown as a sump jet 67, is coupled to a sump 68 of a toilet in a substantially watertight manner, according to another exemplary embodiment. The sump jet 67 includes an inlet portion 67*a* having a generally hollow cylindrical shape that defines a central channel. The inlet portion 67*a* further includes a flared end that defines a hose barb configured to couple to, and be in fluid communication with, a fluid conduit (e.g., conduit 30, etc.). The sump jet 67 further includes an intermediate portion 67*b* extending from the inlet portion 67*a*. The intermediate portion 67*b* defines a flange for coupling the sump jet 67 to the sump 68 in a substantially watertight manner. The intermediate portion 67*b* may be coupled to, or integrally formed with, the sump jet 67. In the exemplary embodiment shown, the intermediate portion 67*b* is generally planar and has a triangular shape with through holes 67*b'* disposed at each corner of the triangle. Although the intermediate portion 67*b* is shown to be triangular in shape with three through holes 67*b'*, it is appreciated that the intermediate portion 67*b* may have other shapes with more or fewer than three through holes (e.g., two, etc.), according to other exemplary embodiments. The sump jet 67 further includes an outlet portion 67*c* extending from the intermediate portion 67*b*. The outlet portion 67*c* includes a plurality of jet orifices 67*c'* in fluid communication with the central channel for introducing a flow of water from a water source into the sump 68. According to an exemplary embodiment, the sump jet 67 may be configured to have the same jet orifice configuration as the sump jet 37 discussed above. According to other exemplary embodiments, the sump jet 67 may have a different jet orifice configuration.

Figure 36:
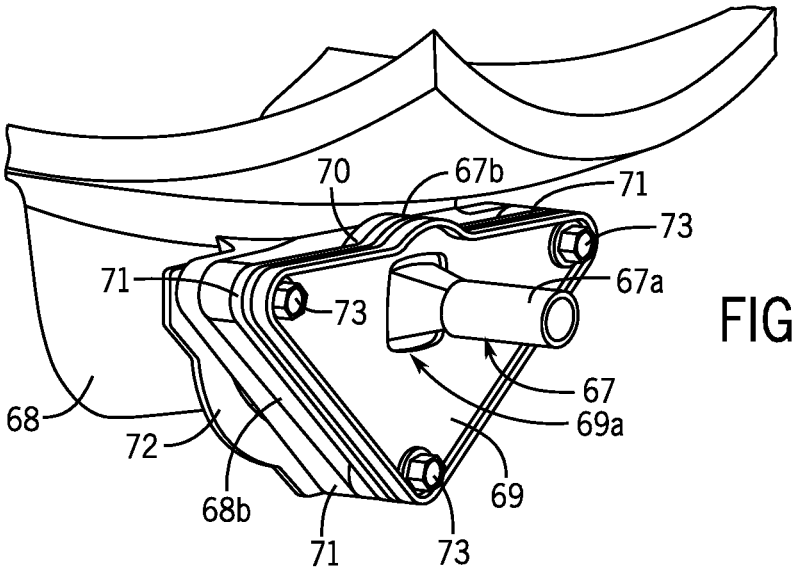
FIG. 36 is a partial cutaway view of a toilet assembly including a non-vitreous fluid delivery component coupled to a toilet according to another exemplary embodiment.
Figure 37:
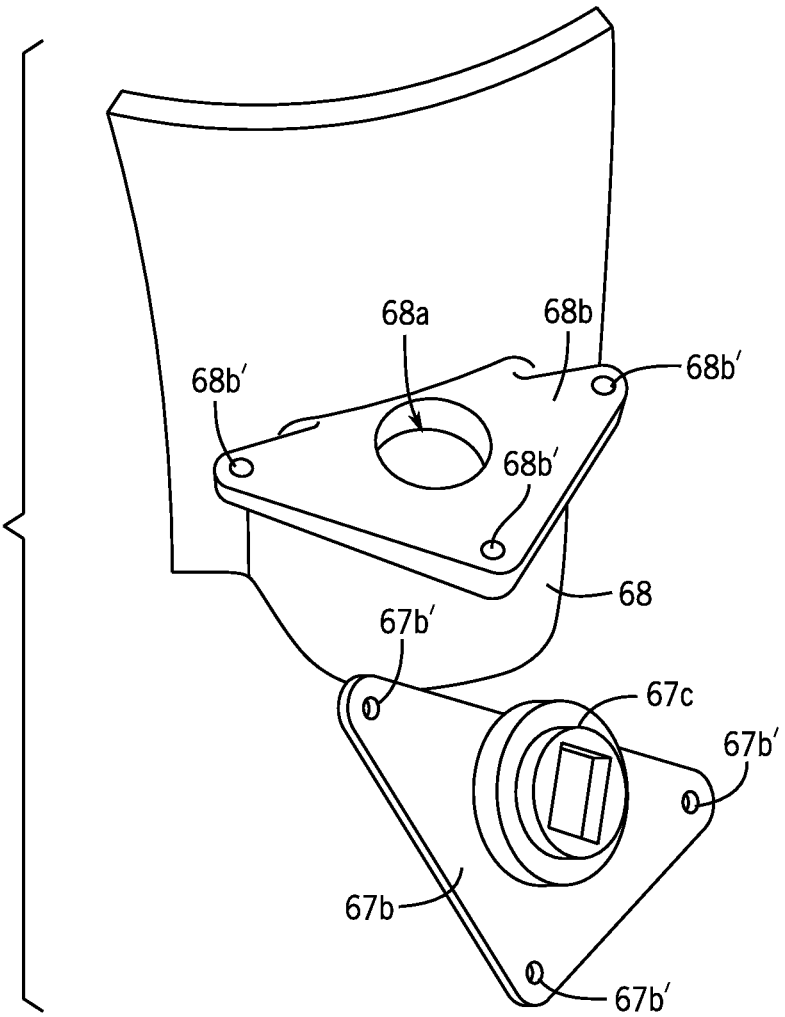
FIG. 37 is an exploded view of a prototype version of the toilet assembly of FIG. 36.
Figure 38:
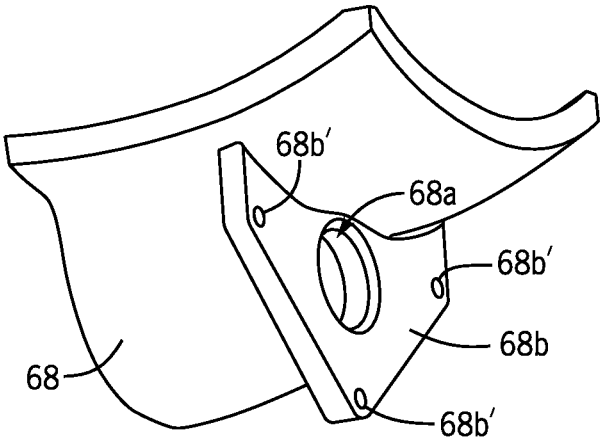
FIGS. 38-39 are partial cutaway views of the toilet of FIG. 36.
Figure 39:
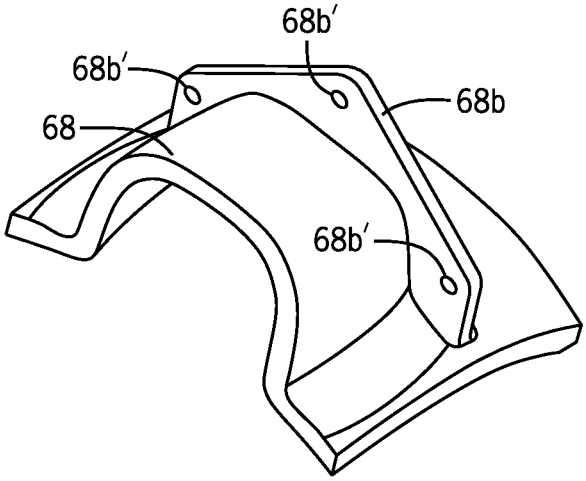
Figure 40:
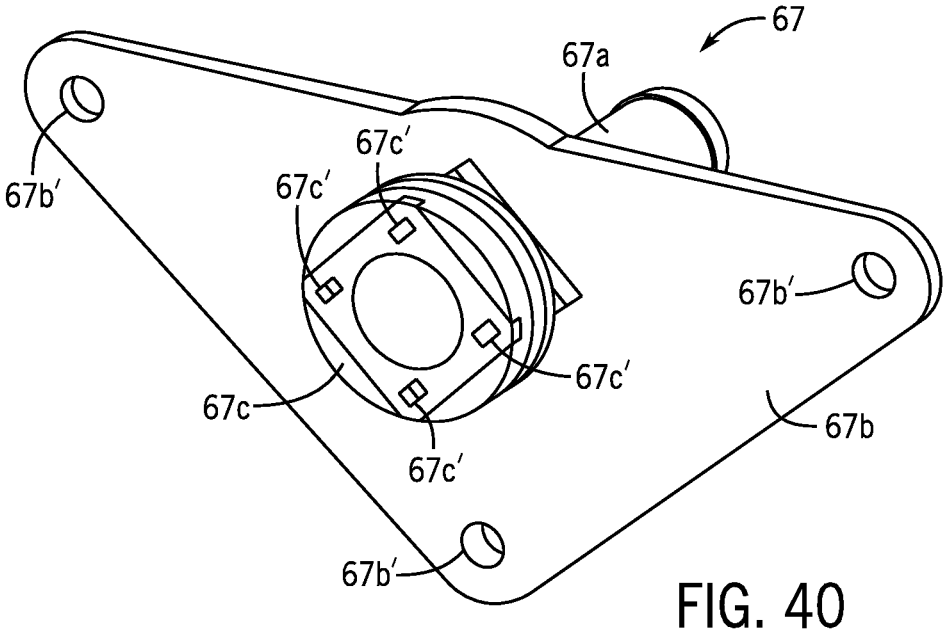
FIG. 40 is a rear perspective view of the non-vitreous fluid delivery component of FIG. 36.
Figure 41:
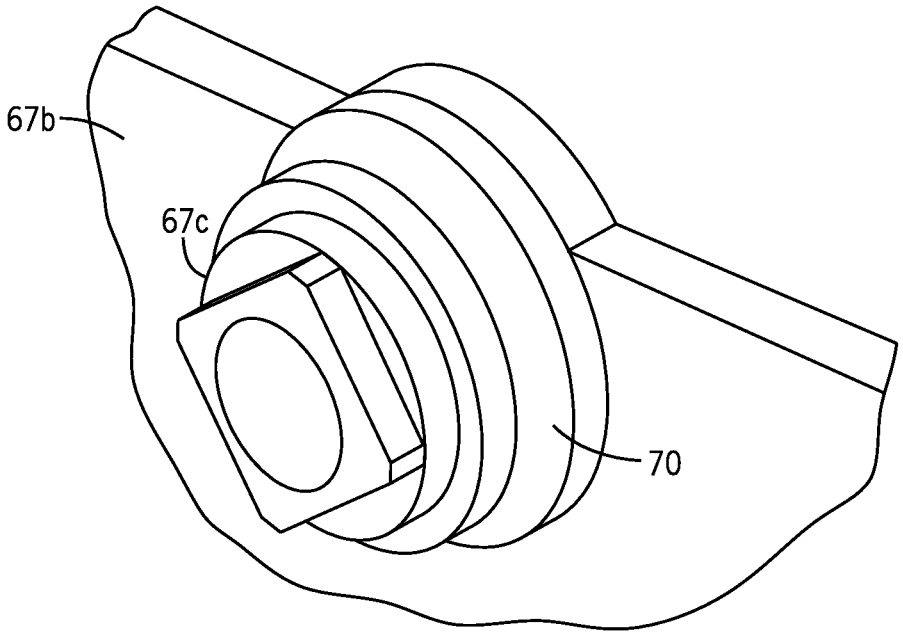
FIGS. 41-42 are partial perspective views of a prototype version of the non-vitreous fluid delivery component of FIG. 36.
Figure 42:
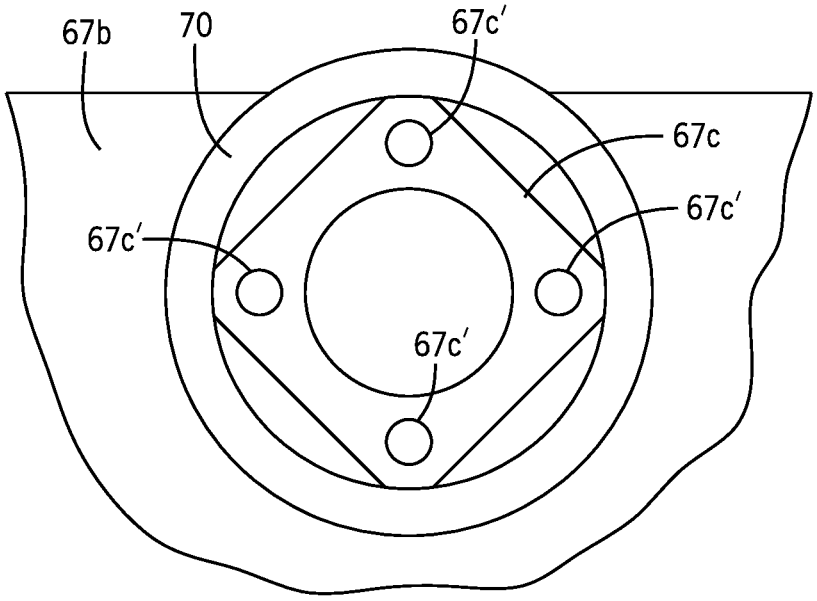

Still referring to FIGS. 36-42, the sump 68 includes an opening 68*a* for receiving at least a portion of the sump jet 67 therein (e.g., outlet portion 67*c*, etc.). The opening 68*a* is defined, in part, by a flange 68*b* extending radially outwardly from the opening 68*a*. The flange 68*b* is generally planar and has a generally triangular shape including through holes 68*b'* that are configured to be aligned with the through holes 67*b'* of the sump jet 67. As shown in FIG. 36, an outer member, shown as a first bracket 69 (e.g., flange, outer cover, etc.), is disposed in front of the sump 68, adjacent the opening 68*a*. The first bracket 69 is generally planar and includes a central opening 69*a* for receiving at least a portion of the inlet portion 67*a* of the sump jet 67 therethrough. The first bracket 69 further includes a plurality of through holes that are configured to be aligned with the respective through holes of the sump jet 67 and the flange 68*b*, such that a bolt 73 can be received therethrough. A second bracket 72 (e.g., mounting member, etc.) is disposed on a rear side of the flange 68*b*, opposite the opening 68*a*. The second bracket 72 is generally planar and includes a plurality of threaded bores (e.g., weld nuts, etc.) configured to threadably engage the respective bolts 73 therein. A plurality of spacers 71 may be disposed between the first bracket 69 and the flange 68*b* to limit the amount of travel of the bolts 73 when the bolts 73 are tightened relative to the second bracket 72.

Still referring to FIG. 36, a sealing member 70 is disposed between the third portion 67*c* of the sump jet 67 and a vitreous portion of the flange 68*b* at the opening 68*a*, so as to create a substantially watertight seal between the sump jet 67 and the sump 68. For example, the sump jet 67 may be coupled to the sump 68 by placing the third portion 67*c* at least partially into the opening 68*a*. The sealing member 70 may be disposed between the intermediate portion 67*b* and the flange 68*b*. The first bracket 69 may be placed over the sump jet 67 such that the first portion 67*a* is disposed through the central opening 69*a* with the respective through holes aligned (i.e., through holes 67*b*'). One or more spacers 71 may be placed between the flange 68*b* and the intermediate portion 67*b*. With the first bracket 69 held in position, the second bracket 72 may be positioned against a rear surface of the flange 68*b* opposite the opening 68*a* with the through holes 68*b*' aligned with the respective threaded bores of the second bracket 72. The bolts 73 may be inserted through the through holes and threadably engaged with the respective threaded bores of the second bracket 72. The bolts 73 may be tightened to the second bracket 72, such that the sealing member 70 is compressed against the vitreous surface of the flange 68*b* adjacent the opening 68*a*, so as to create a substantially watertight seal therebetween. In this way, the non-vitreous sump jet 67 can be coupled to the vitreous sump 68 in a substantially watertight manner.

Referring to FIGS. 43-46, the sump jet 67 is shown coupled to a sump 68' of a toilet in a substantially watertight manner, according to another exemplary embodiment. This exemplary embodiment is the same as the embodiment shown in FIGS. 36-42, except that the sump 68' includes a different flange 68*b*' without any through holes, which may help to simplify the toilet manufacturing process. In addition, the flange 68*b*' does not extend radially outwardly as far as the flange 68*b*, which can help to reduce the amount of vitreous material used to manufacture the toilet, thereby reducing cost.

Figure 43:
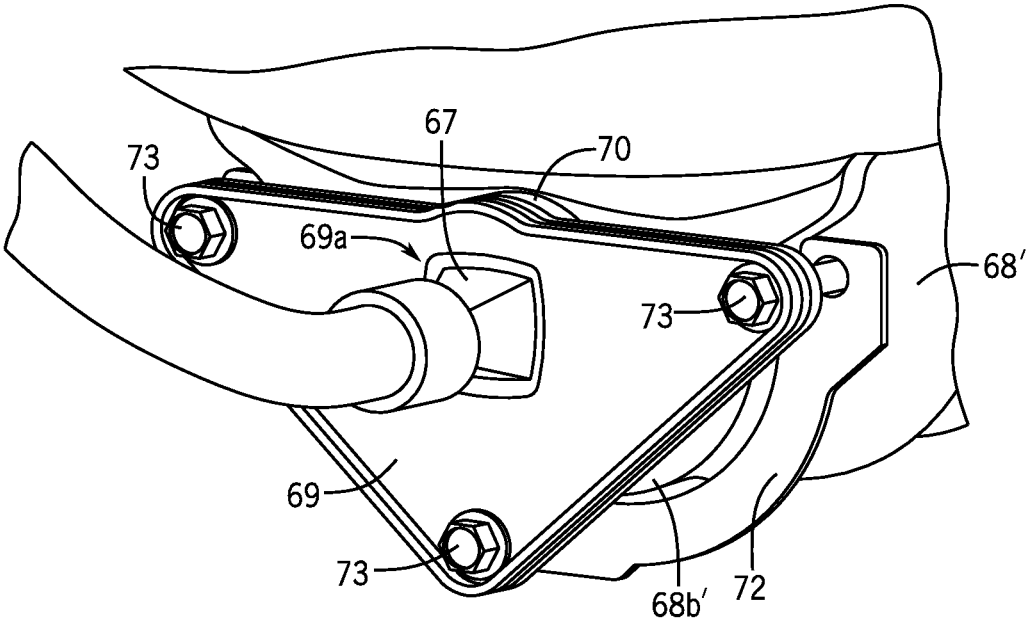
FIGS. 43-46 are partial perspective views of a toilet assembly including a non-vitreous fluid delivery component coupled to a toilet according to another exemplary embodiment.
Figure 44:
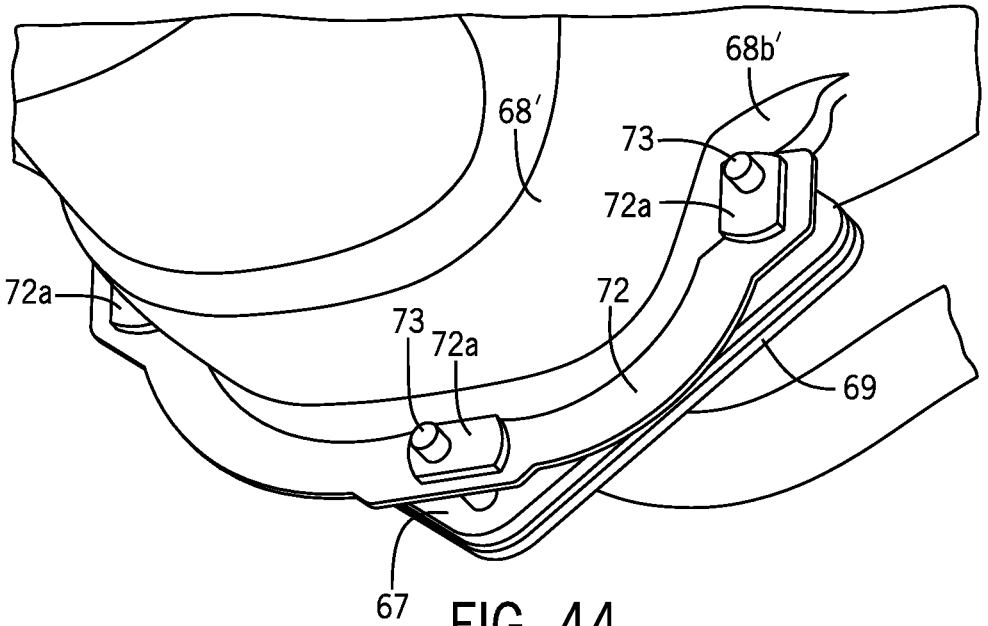

As shown in FIGS. 43-44, the second bracket 72 includes a plurality of weld nuts 72*a* having threaded bores that are configured to be aligned with the respective through holes of the plate 69 and the intermediate portion 67*b* of the sump jet 67. An inner peripheral portion of the second bracket 72 is configured to overlap a rear surface of the flange 68*b*', so as to facilitate coupling of the sump jet 67 to the sump 68'. Thus, when the bolts 73 are threadably engaged with the respective weld nuts 72*a*, the second bracket 72 will be urged or clamped against the flange 68*b*', such that the sealing member 70 can sealingly engage the vitreous portion of the flange 68*b*' and create a substantially watertight seal therebetween.

Figure 45:
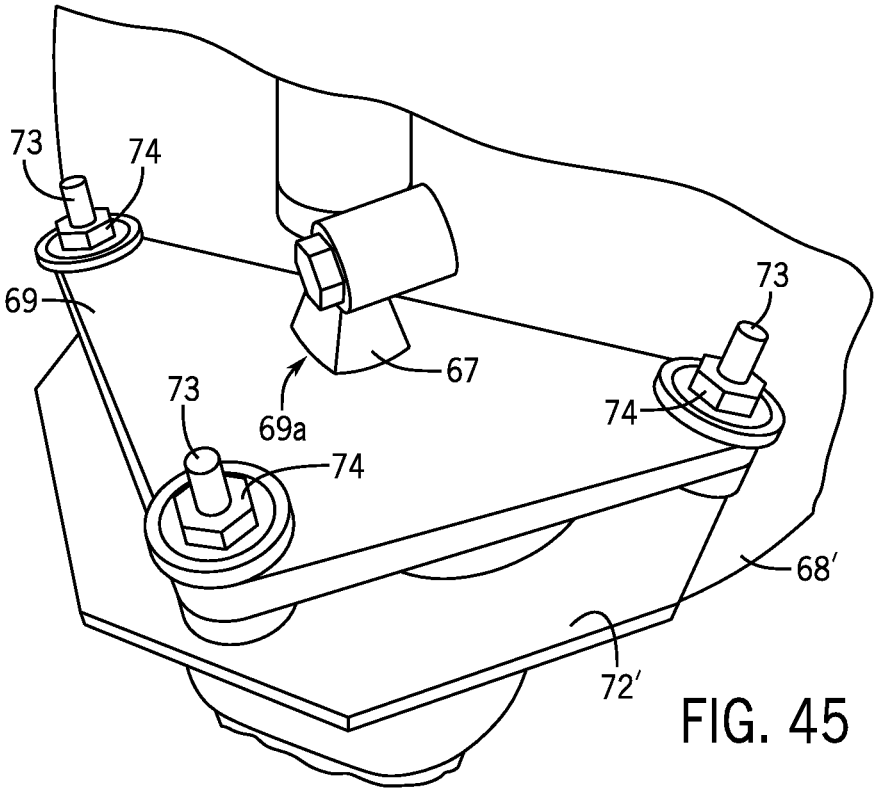
Figure 46:
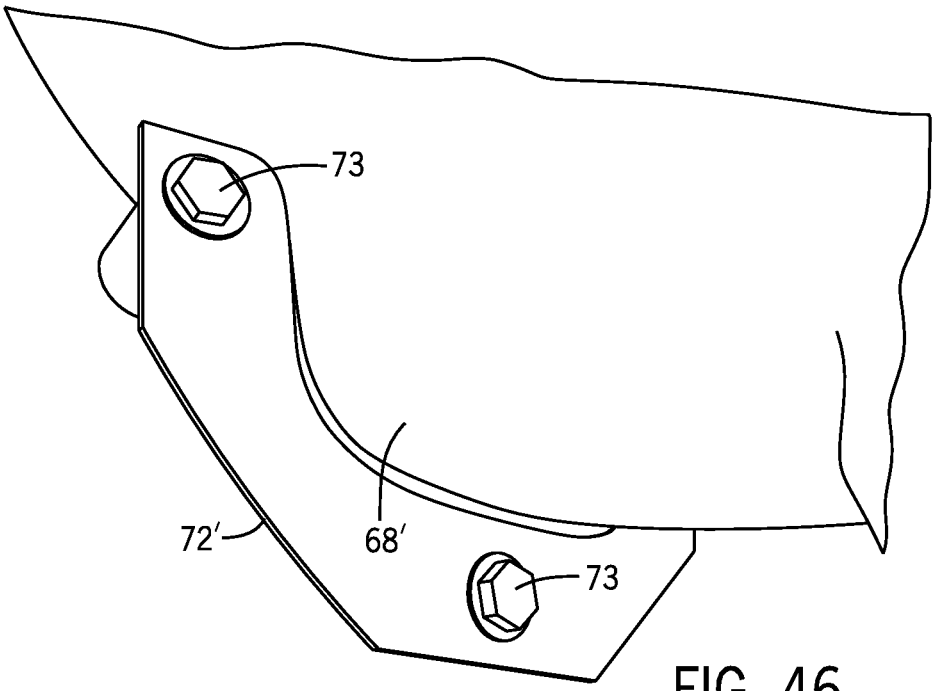

Referring to FIGS. 45-46, a second bracket 72' without any weld nuts or threaded bores is used to couple the sump jet 67 to the sump 68. In this embodiment, the second bracket 72' includes through holes that are configured to receive a bolt 73 therethrough. A nut 74 is threadably coupled to each of the bolts 73 to couple the sump jet 67 to the sump 68' in a substantially watertight manner. According to other exemplary embodiments, other fastening arrangements may be used, such as clips (e.g., spring clips, etc.), bayonet features, press-fit features, or other types of fasteners or fastening arrangements.

The disclosed connectors and connector assemblies provide a substantially watertight seal with a portion of a vitreous toilet (e.g., a toilet sump, a toilet rim, etc.), such that the disclosed non-vitreous fluid delivery components can be fluidly coupled to the toilet in a substantially watertight manner.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that the construction and arrangement of the assemblies as shown in the various exemplary embodiments is illustrative only. Additionally, any element disclosed in one embodiment may be incorporated or utilized with any other embodiment disclosed herein. For example, the sump jet 21 may be incorporated in, or replaced with, the sump jet 37. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A toilet assembly comprising: a toilet;

a non-vitreous fluid delivery component coupled to, and in fluid communication with, the toilet; and a connector assembly coupling the non-vitreous fluid delivery component to the toilet in a substantially watertight manner, a sump;

a chamber coupled to the sump of the toilet;

a cover configured to enclose the chamber, wherein the chamber includes an open area to receive the cover, wherein the non-vitreous fluid delivery component is a sump jet that extends through the chamber and is coupled to the sump, the connector assembly comprising:

a connector body;

a nut adjustably coupled to the connector body; and a sealing member disposed on the connector body;

wherein the nut is configured to be adjusted relative to the connector body to cause the connector body to compress the sealing member against a portion of the toilet, such that the sealing member creates a substantially watertight seal between the toilet and the connector body.

2. The toilet assembly of claim 1, wherein the connector body comprises:

a first portion for fluidly coupling to a conduit;

a second portion extending from the first portion, the second portion including threads for threadably engaging the nut; and a third portion extending from the second portion, wherein the sealing member is disposed on the third portion.

3. The toilet assembly of claim 2, wherein the third portion has a frusto-conical shape, and wherein the connector body includes an opening extending through each of the first, second, and third portions.

4. The toilet assembly of claim 3, wherein the sealing member includes a body and a flange, the flange extending radially away from an end of the body, and wherein the sealing member is arranged on the connector body with the flange facing toward the first portion and the body facing toward the third portion.

5. The toilet assembly of claim 4, wherein the toilet includes an opening for receiving at least a portion of the body therethrough, and wherein the flange is engaged with a surface of the toilet adjacent the opening.

6. The toilet assembly of claim 5, wherein the body of the sealing member extends radially outwardly in the opening of the toilet in response to tightening of the nut on the connector body so as to create the substantially watertight seal between the toilet and the connector body.

7. The toilet assembly of claim 1, wherein the toilet is made from at least one of a vitreous material, an epoxy material, or a ceramic material.

8. The toilet assembly of claim 1, wherein the non-vitreous fluid delivery component is integrally formed with the connector body.

9. The toilet assembly of claim 1, wherein the non-vitreous fluid delivery component is coupled to the connector body.

10. A connector assembly for coupling a non-vitreous fluid delivery component to a toilet, the connector assembly comprising:

a connector body supported by a chamber coupled to a sump of the toilet;

a cover configured to enclose the chamber, wherein the chamber includes an open area to receive the cover;

a nut adjustably coupled to the connector body; and a sealing member disposed on the connector body;

wherein the nut is configured to be adjusted relative to the connector body to cause the connector body to compress the sealing member against a portion of the toilet, such that the sealing member creates a substantially watertight seal between the toilet and the connector body.

11. The connector assembly of claim 10, wherein the connector body comprises:

a first portion for fluidly coupling to a conduit;

a second portion extending from the first portion, the second portion including threads for threadably engaging the nut; and a third portion extending from the second portion, wherein the sealing member is disposed on the third portion.

12. The connector assembly of claim 11, wherein the third portion has a frusto-conical shape, and wherein the connector body includes an opening extending through each of the first, second, and third portions.

13. The connector assembly of claim 12, wherein the sealing member includes a body and a flange, the flange extending radially away from an end of the body, and wherein the sealing member is arranged on the connector body with the flange facing toward the first portion and the body facing toward the third portion.

14. The connector assembly of claim 13, further comprising a non-vitreous fluid delivery component coupled to, or integrally formed with, the connector body.

15. The connector assembly of claim 14, wherein the non-vitreous fluid delivery component is a sump jet configured to be coupled to, and in fluid communication with, a sump of the toilet.

16. The connector assembly of claim 14, wherein the non-vitreous fluid delivery component is configured to be received in an opening of the toilet, and wherein the flange of the sealing member is configured to engage a surface of the toilet adjacent the opening.

17. The connector assembly of claim 15, wherein the body of the sealing member is configured to extend radially outwardly in the opening of the toilet in response to tightening of the nut on the connector body so as to create the substantially watertight seal between the toilet and the connector body.

18. A sump jet assembly for a toilet, the sump jet assembly comprising:

non-vitreous sump jet configured to be coupled to, and in fluid communication with, a sump of the toilet and a chamber coupled to the sump of the toilet;

a cover configured to enclose the chamber, wherein the chamber includes an open area to receive the cover; and a connector assembly for coupling the non-vitreous sump jet to the toilet in a substantially watertight manner, the connector assembly comprising:

a connector body;

a nut adjustably coupled to the connector body; and a sealing member disposed on the connector body;

wherein the nut is configured to be adjusted relative to the connector body to cause the connector body to compress the sealing member against a portion of the toilet, such that the sealing member creates a substantially watertight seal between the toilet and the connector body.

19. The sump jet assembly of claim 18, wherein the connector body comprises:

a first portion for fluidly coupling to a conduit;

a second portion extending from the first portion, the second portion including threads for threadably engaging the nut; and a third portion extending from the second portion, wherein the sealing member is disposed on the third portion.

* * * * *